US008351838B2

(12) United States Patent
Urayama et al.

(10) Patent No.: US 8,351,838 B2
(45) Date of Patent: Jan. 8, 2013

(54) IMAGE BEARING MEMBER-PROTECTING AGENT, PROTECTING AGENT SUPPLYING DEVICE, PROCESS CARTRIDGE, IMAGE FORMING APPARATUS AND IMAGE FORMING METHOD

(75) Inventors: Taichi Urayama, Kanagawa (JP); Hiroshi Nakai, Kanagawa (JP); Kunio Hasegawa, Kanagawa (JP); Shinya Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 242 days.

(21) Appl. No.: 12/805,908

(22) Filed: Aug. 24, 2010

(65) Prior Publication Data

US 2011/0052286 A1 Mar. 3, 2011

(30) Foreign Application Priority Data

Sep. 2, 2009 (JP) ..... 2009-202792

(51) Int. Cl.
*G03G 21/00* (2006.01)

(52) U.S. Cl. ..... 399/346; 399/343

(58) Field of Classification Search ..... 399/123, 399/343, 346; 508/155
See application file for complete search history.

(56) References Cited

U.S. PATENT DOCUMENTS

| | | | | |
|---|---|---|---|---|
| 3,501,294 | A | 3/1970 | Joseph | |
| 6,060,205 | A * | 5/2000 | Takeichi et al. | 399/346 |
| 7,383,013 | B2 | 6/2008 | Watanabe et al. | |
| 2006/0285897 | A1 | 12/2006 | Sugiura et al. | |
| 2009/0196665 | A1 | 8/2009 | Tanaka et al. | |
| 2009/0279930 | A1 | 11/2009 | Kabata et al. | |
| 2009/0285613 | A1 | 11/2009 | Nakai et al. | |
| 2009/0290919 | A1 | 11/2009 | Tanaka et al. | |
| 2009/0290920 | A1 | 11/2009 | Hatakeyama et al. | |
| 2009/0311014 | A1 | 12/2009 | Tanaka et al. | |
| 2010/0034560 | A1 | 2/2010 | Tanaka et al. | |
| 2010/0054829 | A1 | 3/2010 | Iio et al. | |
| 2010/0202812 | A1 * | 8/2010 | Watanabe | 399/346 |
| 2010/0239309 | A1 * | 9/2010 | Tanaka et al. | 399/346 |

FOREIGN PATENT DOCUMENTS

| | | |
|---|---|---|
| EP | 2 259 155 | 12/2010 |
| EP | 2 290 448 | 3/2011 |
| JP | 51-22380 | 7/1976 |
| JP | 2001-305907 | 11/2001 |
| JP | 2006-350240 | 12/2006 |
| JP | 2007-065100 | 3/2007 |
| JP | 2007-293240 | 11/2007 |

OTHER PUBLICATIONS

European Search Report dated Sep. 25, 2012.

* cited by examiner

*Primary Examiner* — David Gray
*Assistant Examiner* — Laura Roth
(74) *Attorney, Agent, or Firm* — Harness, Dickey & Pierce, P.L.C.

(57) ABSTRACT

An image bearing member-protecting agent which is supplied to an image bearing member for protecting the image bearing member, the image bearing member-protecting agent including a fatty acid metal salt and an inorganic lubricant, wherein the image bearing member-protecting agent is formed by compression molding of powder containing at least the fatty acid metal salt and the inorganic lubricant, and wherein the image bearing member-protecting agent satisfies the relation 1.0<A/B, where A denotes a density at end portions in the longitudinal direction of the image bearing member-protecting agent and B denotes a density at a central portion in the longitudinal direction of the image bearing member-protecting agent.

12 Claims, 5 Drawing Sheets

IMAGE BEARING MEMBER-PROTECTING AGENT, PROTECTING AGENT SUPPLYING DEVICE, PROCESS CARTRIDGE, IMAGE FORMING APPARATUS AND IMAGE FORMING METHOD

BACKGROUND OF THE INVENTION

1. Field of the Invention

The present invention relates to an image bearing member-protecting agent which is supplied to an image bearing member contained in image forming apparatuses such as copiers, facsimiles and printers, a protecting agent-supplying device which supplies the image bearing member-protecting agent to an image bearing member, a process cartridge or an image forming apparatus containing the protecting agent-supplying device, and an image forming method using the image forming apparatus.

2. Description of the Related Art

In image forming apparatuses having an image bearing member (e.g., a photoconductor made of, for example, a photoconductive compound), the image bearing member is rotated and subjected sequentially to, for example, a charging step, an exposing step, a developing step, a transfer step and a fixing step for image formation.

In the charging step, the surface of the image bearing member is charged with a charging member such as a charging roller. In the exposing step, a latent electrostatic image is formed on the surface of the image bearing member whose surface has been charged in the charging step. In the developing step, charged tone particles are made to adhere to the latent electrostatic image on the image bearing member surface, to thereby form a visible image. In the transfer step, the visible image is transferred from the image bearing member onto a recording medium (transfer medium) such as paper. In the fixing step, the visible image transferred onto the recording medium is fixed thereon with, for example, heat, pressure or gaseous solvent. Through these steps, an output image is formed on the recording medium.

The developing method in the developing step is roughly classified, depending on the method of charging toner particles, into a two-component developing method and a one-component developing method. In the two-component developing method, toner particles are stirred/mixed with carrier particles and are frictionally charged. In the one-component developing method, toner particles are charged with no use of carrier particles. The one-component developing method is further classified into a magnetic one-component developing method and a non-magnetic one-component developing method, depending on whether or not the developer bearing member (for bearing toner particles) retains toner particles by a magnetic force.

Of these developing methods, the two-component developing method is often employed in, for example, copiers required for high-speed processing and developing reproducibility, and complex machines employing such copiers, in terms of charging stability of the toner particles, charge rising property, long-term stability of image quality, and other requirements. Meanwhile, the one-component developing method is often employed in the compact printers and facsimiles.

In recent years, color images are generally formed, and thus, demand has increasingly arisen for high image quality and stability of image quality. These requirements are intended to be met not by improving the developing method, but by decreasing the average particle diameter of toner particles and using more spherical toner particles. For example, toners produced with the polymerization method are seen on the market. These toners have advantageous features in that they have less angular portions and a uniform average particle diameter, as compared with toners produced with the pulverizing method. In addition, the polymerized toners contribute to not only improvement of image quality but also saving of production energy.

The image bearing member having undergone the transfer step has, on the surface thereof, residual toner components which have not been transferred onto the transfer medium. When charged again in the charging step in this state, the image bearing member is not uniformly charged in many cases. Thus, in general, a cleaning step is additionally provided after the transfer step and before the next charging step. In the cleaning step, the toner components and other foreign matters (e.g., paper dust) remaining on the image bearing member are removed with a cleaning member such as a cleaning blade, and the image bearing member surface is sufficiently cleaned before the charging step.

The recent toner particles have a smaller average particle diameter and a more spherical shape as described above. Such toner particles are more difficult to remove in the cleaning step. In one countermeasure against this, the cleaning member is pressed against the image bearing member surface at larger pressures.

As described above, the image bearing member receives various physical or electrical stresses in the above steps, and the state thereof changes over time, especially after long-term use. For example, the image bearing member receives considerable electrical stress in the contact charging method or close-contact charging method (which involves a discharging phenomenon in the vicinity of the image bearing member surface), since, in these charging methods, many active species or reaction products are formed on the image bearing member surface, and active species or reaction products formed in air within the discharging region adsorb on the image bearing member surface in a large amount. Also, it is known that, when the alternating voltage is employed in the charging step, the stress caused by the application of the voltage abrades the image bearing member. In addition, as has been known, the stress caused by the friction in the cleaning step abrades and scratches the image bearing member, and also abrades the cleaning member. Thus, conventionally, many researchers have proposed methods of supplying a lubricant or lubricating ingredients and of forming a film on the image bearing member surface from the lubricant or lubricating ingredients, in order to reduce, the friction force between the image bearing member and the cleaning member.

For example, some patent literatures disclose techniques of forming a lubricant film on the surface of a photoconductor (image bearing member) by supplying a lubricant (image bearing member-protecting agent) onto the photoconductor surface to elongate the service lives of the photoconductor and the cleaning member (see, for example, Japanese Patent Application Publication (JP-B) No. 51-22380, and Japanese Patent Application Laid-Open (JP-A) Nos. 2001-305907, 2007-293240, 2007-65100 and 2006-350240). Using the above techniques, the stress applied to the image bearing member in, for example, the charging step can be easily reduced.

Meanwhile, for the lubricant, there are known lubricants mainly containing a fatty acid zinc salt (see, for example, JP-B No. 51-22380 and JP-A Nos. 2001-305907, 2007-293240 and 2007-65100) and lubricants containing a fatty acid metal salt and an inorganic lubricant (see, for example, JP-A No. 2006-350240). The latter lubricants decrease in lubricity to a less extent than in the former lubricants, even when receiving the stress due to discharge in the charging step. In addition, even when the recent small/spherical toner particles are used, the latter lubricants are suitable for suppressing or preventing the cleaning member from being abraded, and suppressing or preventing the toner particles from running through the cleaning member to stain the charging member or adversely affect the formed image. Furthermore, they are suitable for suppressing or preventing the lubricating ingredients as well as toner particles from running through the cleaning member to stain the charging member.

In recent years, cleaning performance for toner has been remarkably improved in the cleaning steps, and the recent small and highly spherical toner particles are cleaned effectively. Such improved cleaning performance prevents toner particles from running through the cleaning step, which prevents the photoconductor and cleaning member from being abraded (i.e., their service lives from being shortened) and the charging member from being stained (i.e., the service life from being shortened). In view of this, the supply of the latter lubricant onto the photoconductor is advantageous in elongating the service lives of the photoconductor, the cleaning member (in the cleaning step) and the charging member.

In one known configuration in which a lubricant is supplied to the photoconductor surface, a brush is rubbed against a solid bar lubricant so that the lubricant is scraped off and supplied to the photoconductor (see, for example, JP-A Nos. 2001-305907, 2007-293240, 2007-65100 and 2006-350240).

In another known configuration in which a lubricant is supplied to the photoconductor surface, a solid lubricant is elastically brought into contact with a brush to maintain constant, for a long period of time, the amount of the lubricant supplied to the photoconductor (see, for example, JP-A Nos. 2001-305907, 2007-293240 and 2007-65100). Furthermore, there have been proposed various configurations for stabilizing, for a long period of time, the amount of the lubricant supplied to the photoconductor (see, for example, JP-A Nos. 2007-293240 and 2007-65100).

Meanwhile, compression molding and melt molding are known as methods of solidifying a lubricant so as to have a bar shape (see, for example, JP-A No. 2006-350240). The lubricant obtained through melt molding is harder than that obtained through compression molding. Thus, the amount of the former lubricant supplied to the photoconductor is problematically decreased. In particular, as revealed from the studies of the present inventors, a lubricant formed by mixing an inorganic lubricant with a fatty acid metal salt is likely to raise this problem. This is probably because the inorganic lubricant serves as a filler.

Therefore, in order to ensure the amount of a lubricant supplied to a photoconductor and to elongate service lives of a photoconductor, a cleaning member and a charging member, it is desired that compression molding is employed to mold/solidify a lubricant containing a fatty acid metal salt and an inorganic lubricant.

The lubricant molded/solidified through compression molding is soft. When such a soft lubricant is used in conventional configurations which stabilize for a long period of time the amount of a lubricant supplied to a photoconductor (see, for example, JP-A Nos. 2007-293240 and 2007-65100), a brush is rubbed ununiformly against the lubricant (protecting agent) to mainly consume the protecting agent at one side only (ununiform scraping). As a result, the amount of the lubricant supplied is not sufficiently consistent for a long period of time.

BRIEF SUMMARY OF THE INVENTION

The present invention aims to provide an image bearing member-protecting agent which can be consistently supplied to an image bearing member in a sufficient amount, a protecting agent-supplying device which supplies the image bearing member-protecting agent to an image bearing member, a process cartridge or an image forming apparatus containing the protecting agent-supplying device, and an image forming method using the image forming apparatus.

Means for solving the above problems are as follows.

<1> An image bearing member-protecting agent which is supplied to an image bearing member for protecting the image bearing member, the image bearing member-protecting agent including:

a fatty acid metal salt, and an inorganic lubricant, wherein the image bearing member-protecting agent is formed by compression molding of powder containing at least the fatty acid metal salt and the inorganic lubricant, and wherein the image bearing member-protecting agent satisfies the relation $1.0<A/B$, where A denotes a density at end portions in the longitudinal direction of the image bearing member-protecting agent and B denotes a density at a central portion in the longitudinal direction of the image bearing member-protecting agent.

<2> The image bearing member-protecting agent according to <1> above, wherein the image bearing member-protecting agent satisfies the relation $1.0<A/B\leqq 1.45$.

<3> The image bearing member-protecting agent according to <1> above, wherein the fatty acid metal salt is zinc stearate.

<4> The image bearing member-protecting agent according to <1> above, wherein the inorganic lubricant is boron nitride.

<5> A protecting agent-supplying device including:

an image bearing member-protecting agent which is supplied to an image bearing member for protecting the image bearing member, wherein the image bearing member-protecting agent includes a fatty acid metal salt and an inorganic lubricant, wherein the image bearing member-protecting agent is formed by compression molding of powder containing at least the fatty acid metal salt and the inorganic lubricant, and wherein the image bearing member-protecting agent satisfies the relation $1.0<A/B$, where A denotes a density at end portions in the longitudinal direction of the image bearing member-protecting agent and B denotes a density at a central portion in the longitudinal direction of the image bearing member-protecting agent.

<6> The protecting agent-supplying device according to <5> above, further including a supplying member which scrapes off the image bearing member-protecting agent and supplies the image bearing member-protecting agent to an image bearing member.

<7> The protecting agent-supplying device according to <5> above, further including a layer-forming member which forms a layer, on the image bearing member, of the image bearing member-protecting agent supplied on the image bearing member.

<8> A process cartridge including:

an image bearing member, and an image bearing member-protecting agent which is supplied to the image bearing member for protecting the image bearing member, wherein the image bearing member-protecting agent includes a fatty acid metal salt and an inorganic lubricant, wherein the image bearing member-protecting agent is formed by compression molding of powder containing at least the fatty acid metal salt and the inorganic lubricant, and wherein the image bearing member-protecting agent satisfies the relation 1.0<A/B, where A denotes a density at end portions in the longitudinal direction of the image bearing member-protecting agent and B denotes a density at a central portion in the longitudinal direction of the image bearing member-protecting agent.

<9> An image forming apparatus including:

the process cartridge according to <8> above.

<10> An image forming apparatus including:

a protecting agent-supplying device, and an image bearing member, wherein the protecting agent-supplying device includes an image bearing member-protecting agent which is supplied to the image bearing member for protecting the image bearing member, wherein the image bearing member-protecting agent includes a fatty acid metal salt and an inorganic lubricant, wherein the image bearing member-protecting agent is formed by compression molding of powder containing at least the fatty acid metal salt and the inorganic lubricant, and wherein the image bearing member-protecting agent satisfies the relation 1.0<A/B, where A denotes a density at end portions in the longitudinal direction of the image bearing member-protecting agent and B denotes a density at a central portion in the longitudinal direction of the image bearing member-protecting agent.

<11> An image forming apparatus including:

a protecting agent-supplying device, an image bearing member, a cleaning device for removing from the image bearing member toner particles remaining on the image bearing member, and wherein the cleaning device is provided so as to be in contact with the image bearing member, and wherein the cleaning device is located, in a direction in which the image bearing member is moved, downstream of a position where a toner image on the image bearing member is transferred onto a recording medium but upstream of a position where an image-bearing member protecting agent is supplied by the protecting agent-supplying device.

<12> The image forming apparatus according to <10> above, wherein the image bearing member has a layer containing a thermosetting resin at least the uppermost surface thereof.

<13> The image forming apparatus according to <10> above, further including a charging unit which is provided so as to face the image bearing member and configured to charge the image bearing member.

<14> The image forming apparatus according to <10> above, wherein the charging unit includes a voltage-applying unit configured to apply a voltage containing an alternating-current component.

<15> An image forming method including:

performing image formation with an image forming apparatus, wherein the image forming apparatus includes an image bearing member and an image bearing member-protecting agent which is supplied to the image bearing member for protecting the image bearing member, wherein the image bearing member-protecting agent includes a fatty acid metal salt and an inorganic lubricant, wherein the image bearing member-protecting agent is formed by compression molding of powder containing at least the fatty acid metal salt and the inorganic lubricant, and wherein the image bearing member-protecting agent satisfies the relation 1.0<A/B, where A denotes a density at end portions in the longitudinal direction of the image bearing member-protecting agent and B denotes a density at a central portion in the longitudinal direction of the image bearing member-protecting agent.

The present invention provides an image bearing member-protecting agent which is supplied to protect an image bearing member and is formed by compression molding of powder containing at least a fatty acid metal salt and an inorganic lubricant. The image bearing member-protecting agent satisfies the relation 1.0<A/B, where A denotes a density at end portions in the longitudinal direction of the image bearing member-protecting agent and B denotes a density at a central portion in the longitudinal direction of the image bearing member-protecting agent. Thus, the image bearing member-protecting agent is prevented from being ununiformly consumed, and is elongated in service life. In addition, the image bearing member-protecting agent can be consistently supplied in a sufficient amount to the image bearing member for a long period of time. The image bearing member can be prevented from being degraded due to abrasion and from being stained due to filming. Also, when a charging member is disposed so as to face the image bearing member, the charging member can be prevented from being stained. Thus, the protecting agent-supplying device can contribute to elongation of the service lives of the image bearing member and other members, and also to favorable image formation.

When the image bearing member-protecting agent satisfies the relation 1.0<A/B≦1.45, the image bearing member-protecting agent is highly prevented from being ununiformly consumed, and is further elongated in service life. In addition, the image bearing member-protecting agent can be consistently supplied in a sufficient amount to the image bearing member for a long period of time. The image bearing member can be prevented from being degraded due to abrasion and from being stained due to filming. Also, when a charging member is disposed so as to face the image bearing member, the charging member can be prevented from being stained. Thus, the protecting agent-supplying device can contribute to elongation of the service lives of the image bearing member and other members, and also to favorable image formation.

When the fatty acid metal salt is zinc stearate which is cheap, highly hydrophobic and remarkably stable and is excellent in protection of an image bearing member, the image bearing member-protecting agent is prevented from being ununiformly consumed, and is elongated in service life. In addition, the image bearing member-protecting agent can be consistently supplied in a sufficient amount to the image bearing member for a long period of time. In particular, the image bearing member can be prevented from being degraded due to abrasion and from being stained due to filming. Also, when a charging member is disposed so as to face the image bearing member, the charging member can be prevented from being stained. Thus, the protecting agent-supplying device can contribute to elongation of the service lives of the image bearing member and other members, and also to favorable image formation.

When the inorganic lubricant is boron nitride which particularly effectively prevents a charging member from being stained, the image bearing member-protecting agent is prevented from being ununiformly consumed, and is elongated in service life. In addition, the image bearing member-protecting agent can be consistently supplied in a sufficient amount to the image bearing member for a long period of time. The image bearing member can be prevented from being degraded due to abrasion and from being stained due to filming. Also, especially when a charging member is disposed so as to face the image bearing member, the charging member can be prevented from being stained. Thus, the protecting agent-supplying device can contribute to elongation of the service lives of the image bearing member and other members, and also to favorable image formation.

The protecting agent-supplying device of the present invention contains the above-described image bearing member-protecting agent. Thus, the image bearing member-protecting agent is prevented from being ununiformly consumed, and is elongated in service life. In addition, the image bearing member-protecting agent can be consistently supplied in a sufficient amount to the image bearing member for a long period of time. The image bearing member can be prevented from being degraded due to abrasion and from being stained due to filming. Also, when a charging member is disposed so as to face the image bearing member, the charging member can be prevented from being stained. Thus, the protecting agent-supplying device can contribute to elongation of the service lives of the image bearing member and other members, and also to favorable image formation.

When the protecting agent-supplying device of the present invention contains a supplying member which scrapes off the image bearing member-protecting agent and supplies the image bearing member-protecting agent to an image bearing member, the image bearing member-protecting agent is prevented from being ununiformly consumed by the supplying member, and is elongated in service life. In addition, the image bearing member-protecting agent can be supplied by the supplying member in a sufficient amount to the image bearing member for a long period of time. The image bearing member can be prevented from being degraded due to abrasion and from being stained due to filming. Also, when a charging member is disposed so as to face the image bearing member, the charging member can be prevented from being stained. Thus, the protecting agent-supplying device can contribute to elongation of the service lives of the image bearing member and other members, and also to favorable image formation.

When the protecting agent-supplying device of the present invention contains a layer-forming member which forms a layer, on an image bearing member, of the image bearing member-protecting agent supplied to the image bearing member, the image bearing member-protecting agent can effectively protect the image bearing member. Also, when the image bearing member is exposed to light, unfavorable phenomena due to the image bearing member-protecting agent during light exposure can be prevented from occurring. Also, the image bearing member-protecting agent is prevented from being ununiformly consumed, and is elongated in service life. In addition, the image bearing member-protecting agent can be consistently supplied in a sufficient amount to the image bearing member for a long period of time. The image bearing member can be prevented from being degraded due to abrasion and from being stained due to filming. Also, when a charging member is disposed so as to face the image bearing member, the charging member can be prevented from being stained. Thus, the protecting agent-supplying device can contribute to elongation of the service lives of the image bearing member and other members, and also to favorable image formation.

The process cartridge of the present invention contains the above-described protecting agent-supplying device and an image bearing member. In this process cartridge, the image bearing member-protecting agent is prevented from being ununiformly consumed, and is elongated in service life. In addition, the image bearing member-protecting agent can be consistently supplied in a sufficient amount to the image bearing member for a long period of time. The image bearing member can be prevented from being degraded due to abrasion and from being stained due to filming. Also, when a charging member is disposed so as to face the image bearing member, the charging member can be prevented from being stained. Thus, the protecting agent-supplying device can contribute to elongation of the service lives of the image bearing member and other members, and also to favorable image formation. Furthermore, the process cartridge can be elongated in service life before replacement, and the constituent parts (e.g., the image bearing member) can be reused to attain waste reduction.

The image forming apparatus of the present invention contains the above-described process cartridge. In this image forming apparatus, the image bearing member-protecting agent is prevented from being ununiformly consumed, and is elongated in service life. In addition, the image bearing member-protecting agent can be consistently supplied in a sufficient amount to the image bearing member for a long period of time. The image bearing member can be prevented from being degraded due to abrasion and from being stained due to filming. Also, when a charging member is disposed so as to face the image bearing member, the charging member can be prevented from being stained. Thus, the protecting agent-supplying device can elongate the service lives of the image bearing member and other members, and also perform favorable image formation. Furthermore, the process cartridge can be elongated in service life before replacement to reduce running cost, and the constituent parts (e.g., the image bearing member) can be reused to attain waste reduction.

The image forming apparatus of the present invention contains the above-described protecting agent-supplying device and an image bearing member. In this image forming apparatus, the image bearing member-protecting agent is prevented from being ununiformly consumed, and is elongated in service life. In addition, the image bearing member-protecting agent can be consistently supplied in a sufficient amount to the image bearing member for a long period of time. The image bearing member can be prevented from being degraded due to abrasion and from being stained due to filming. Also, when a charging member is disposed so as to face the image bearing member, the charging member can be prevented from being stained. Thus, the protecting agent-supplying device can elongate the service lives of the image bearing member and other members, and also perform favorable image formation for a long period of time. Furthermore, the image bearing member can be elongated in service life before replacement to reduce running cost, and the constituent parts (e.g., the image bearing member) can be reused to attain waste reduction.

When the image forming apparatus of the present invention further includes a cleaning device which is provided so as to be in contact with the image bearing member and is located, in a direction in which the image bearing member is moved, downstream of a position where a toner image on the image bearing member is transferred onto a recording medium but upstream of a position where the image bearing member-protecting agent is supplied by the protecting agent-supplying device, the image bearing member-protecting agent can be applied to the image bearing member having undergone cleaning by the cleaning device, and thus, the image bearing member can be effectively protected by the image bearing member-protecting agent. In this image forming apparatus, the image bearing member-protecting agent is prevented from being ununiformly consumed, and is elongated in service life. In addition, the image bearing member-protecting agent can be consistently supplied in a sufficient amount to the image bearing member for a long period of time. The image bearing member can be prevented from being degraded due to abrasion and from being stained due to filming. Also, when a charging member is disposed so as to face the image bearing member, the charging member can be prevented from being stained. Thus, the protecting agent-supplying device can elongate the service lives of the image bearing member and other members, and also perform favorable image formation for a long period of time. Furthermore, the image bearing member can be elongated in service life before replacement to reduce running cost, and the constituent parts (e.g., the image bearing member) can be reused to attain waste reduction.

When the image bearing member has a layer containing a thermosetting resin at least the uppermost surface thereof, the image bearing member can be elongated to such an extent that requires substantially no replacement. And, the image bearing member-protecting agent is prevented from being ununiformly consumed, and is elongated in service life. In addition, the image bearing member-protecting agent can be consistently supplied in a sufficient amount to the image bearing member for a long period of time. The image bearing member can be prevented from being degraded due to abrasion and from being stained due to filming. Also, when a charging member is disposed so as to face the image bearing member, the charging member can be prevented from being stained. Thus, the protecting agent-supplying device can elongate the service lives of the image bearing member and other members, and also perform favorable image formation for a long period of time. Furthermore, the image bearing member can be elongated in service life before replacement to reduce running cost, and the constituent parts (e.g., the image bearing member) can be reused to attain waste reduction.

When the image forming apparatus further includes a charging unit provided so as to face the image bearing member and configured to charge the image bearing member, the charging unit can be prevented from being stained, and also from giving electrical stress to the image bearing member. And, the image bearing member-protecting agent is prevented from being ununiformly consumed, and is elongated in service life. In addition, the image bearing member-protecting agent can be consistently supplied in a sufficient amount to the image bearing member for a long period of time. The image bearing member can be prevented from being degraded due to abrasion and from being stained due to filming. Thus, the protecting agent-supplying device can elongate the service lives of the image bearing member and the charging unit, and also perform favorable image formation for a long period of time. Furthermore, the image bearing member and the charging unit can be elongated in service life before replacement to reduce running cost, and the constituent parts of the charging unit can be reused to attain waste reduction.

When the charging unit includes a voltage-applying unit configured to apply a voltage containing an alternating-current component, high electrical stress (caused by a voltage containing an alternating-current component derived from the charging unit) applied on the image bearing member can be suppressed. And, the image bearing member-protecting agent is prevented from being ununiformly consumed, and is elongated in service life. In addition, the image bearing member-protecting agent can be consistently supplied in a sufficient amount to the image bearing member for a long period of time. The image bearing member can be prevented from being degraded due to abrasion and from being stained due to filming. Also, the charging unit can be prevented from being stained. Thus, the protecting agent-supplying device can elongate the service lives of the image bearing member and the charging unit, and also perform favorable image formation for a long period of time. Furthermore, the image bearing member and the charging unit can be elongated in service life before replacement to reduce running cost, and the constituent parts of the charging unit can be reused to attain waste reduction.

The image forming method of the present invention performs image formation with the above-described image forming apparatus. In this image forming method, the image bearing member-protecting agent is prevented from being ununiformly consumed, and is elongated in service life. In addition, the image bearing member-protecting agent can be consistently supplied in a sufficient amount to the image bearing member for a long period of time. The image bearing member can be prevented from being degraded due to abrasion and from being stained due to filming. Also, when a charging member is disposed so as to face the image bearing member, the charging member can be prevented from being stained. Thus, the protecting agent-supplying device can elongate the service lives of the image bearing member and other members, and also perform favorable image formation for a long period of time. Furthermore, the image bearing member can be elongated in service life before replacement to reduce running cost, and the constituent parts (e.g., the image bearing member) can be reused to attain waste reduction.

DETAILED DESCRIPTION OF THE INVENTION

Figure 1:
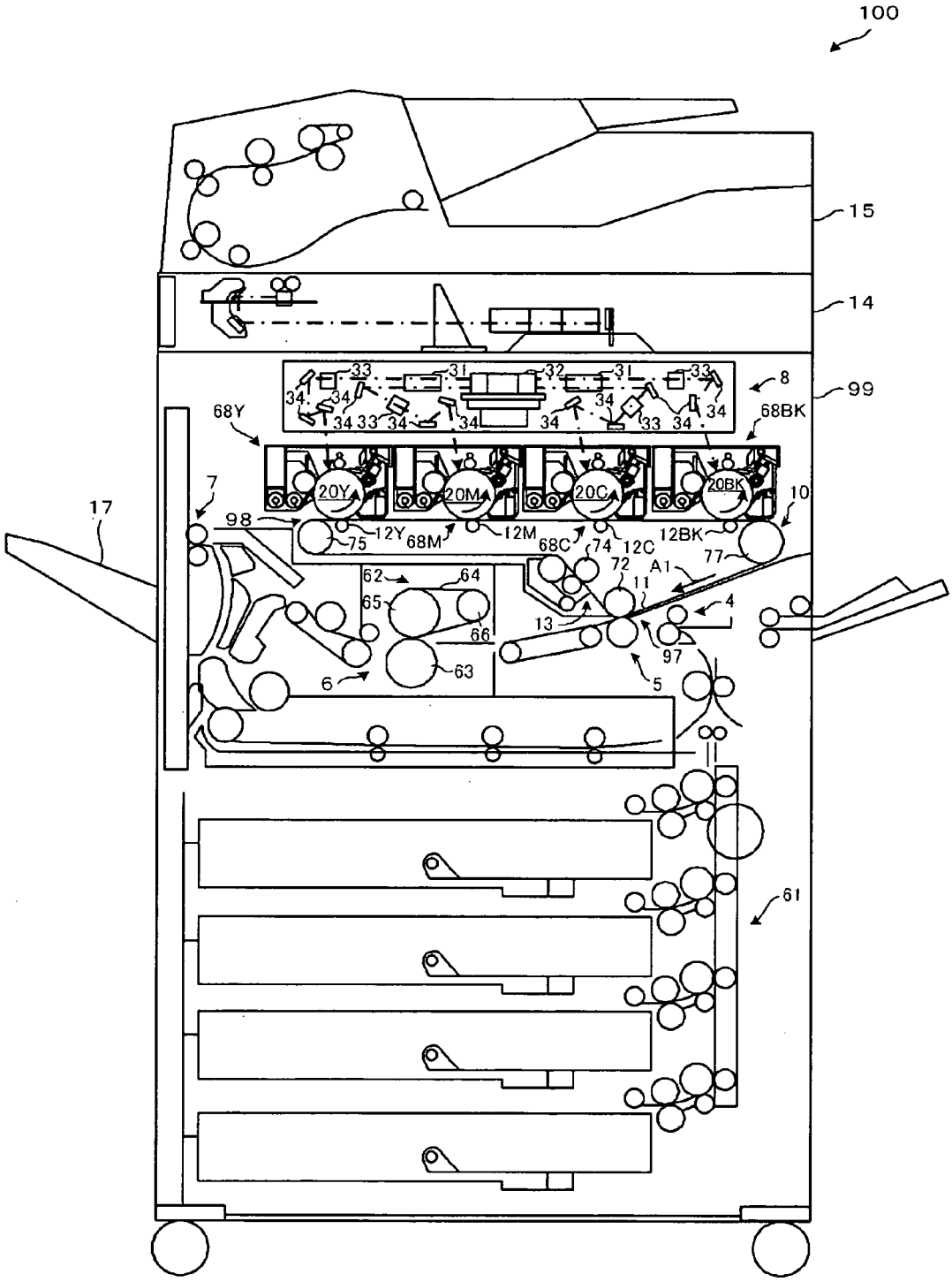
FIG. 1 is a schematic elevation of an image forming apparatus to which the present invention is applied.

Next, the present invention will be described with reference to the drawings. Reference numerals in the following description correspond to those described in FIGS. 1 to 5.

(Image Bearing Member-Protecting Agent)

An image bearing member-protecting agent of the present invention (hereinafter may be referred to simply as a "protecting agent") is formed by compression molding of powder containing at least a fatty acid metal salt and an inorganic lubricant. The image bearing member-protecting agent satisfies the relation $1.0<A/B$, where A denotes a density at end portions in the longitudinal (width) direction (indicated by X in FIG. 5) of the image bearing member-protecting agent and B denotes a density at a central portion in the longitudinal direction of the image bearing member-protecting agent. That is, density A at the end portions is higher than density B at the central portion. Here, the above longitudinal direction corresponds to the longitudinal direction of a brush roller 47Y or a photoconductor drum 20Y contained in the image forming apparatus. Note that, in FIG. 5, Y corresponds to the height direction, and Z corresponds to the traverse direction.

Densities A and B preferably satisfy the relation $1.0<A/B\leqq 1.5$, more preferably $1.0<A/B\leqq 1.45$. The grounds for this relation between densities A and B are clearly given in the below-described Examples and Comparative Examples.

Notably, each of the end portions in the protecting agent 42Y is an end portion corresponding to 1/10 of the total length of the protecting agent 42Y in the longitudinal direction of the protecting agent 42Y. The central portion in the protecting agent 42Y is a central portion corresponding to 1/3 of the total length of the protecting agent 42Y in the longitudinal direction of the protecting agent 42Y.

For the following reasons, the protecting agent 42Y is formed by mixing the inorganic lubricant with the fatty acid metal salt. Specifically, when affected by discharge in a charging step, the protecting agent 42Y decreases in lubricity to a less extent than the protecting agent containing the fatty acid metal salt as a main component. In addition, the protecting agent 42Y is suitably used for suppressing or preventing toner particles from running through a cleaning blade 78Y to stain a charging roller 91Y, to adversely affect formed images and to abrade the cleaning blade 78Y. Furthermore, the protecting agent 42Y is suitably used for suppressing or preventing itself (together with toner particles) from running through the cleaning blade 78Y to stain the charging roller 91Y.

Examples of the fatty acid metal salt include, but are not limited to, barium stearate, lead stearate, iron stearate, nickel stearate, cobalt stearate, copper stearate, strontium stearate, calcium stearate, cadmium stearate, magnesium stearate, zinc stearate, zinc oleate, manganese oleate, iron oleate, cobalt oleate, copper oleate, lead oleate, magnesium oleate, zinc palmitate, cobalt palmitate, lead palmitate, magnesium palmitate, aluminum palmitate, calcium palmitate, lead caprylate, lead caprate, zinc linoleate, cobalt linoleate, calcium linoleate, zinc ricinoleate, cadmium ricinoleate and mixtures thereof. These may be used in combination. Most preferably, the fatty acid metal salt contains zinc stearate. This is because, as is clear from Examples given below, zinc stearate contributes to effective protection of the photoconductor drum 20Y, and also, stearic acid is the cheapest among higher fatty acids. Furthermore, a zinc salt of stearic acid is a highly hydrophobic, remarkably stable compound. Thus, the protecting agent 42Y preferably contains zinc stearate.

The inorganic lubricant refers to a compound which is cleaved by itself to exhibit lubricity or is slid therein. Examples of the inorganic lubricant include, but are not limited to, mica, boron nitride, molybdenum disulfide, tungsten disulfide, talc, kaolin, montmorillonite, calcium fluoride and graphite. Boron nitride is a compound having hexagonal lattice planes (layers) (each being formed of firmly bonded atoms) which are superposed on top of the other at large intervals via weak van der Waals force, and are easily cleaved to exhibit lubricity. As is clear from Examples given below, boron nitride is most suitable for protecting the charging roller 91Y from staining. Therefore, the protecting agent 42Y in the present embodiment preferably contains boron nitride as the inorganic lubricant.

Figure 3:
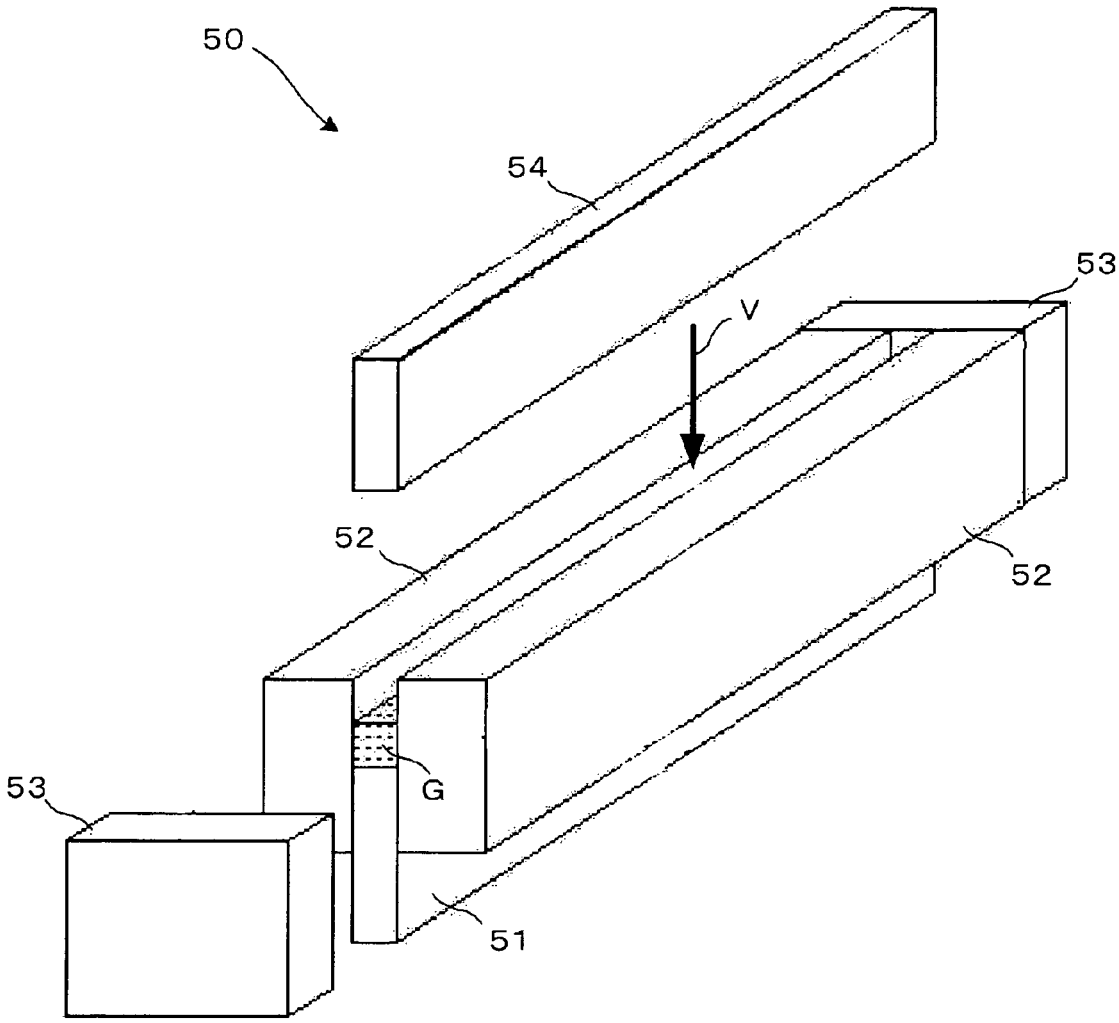
FIG. 3 is an exploded perspective, schematic partial view of a production apparatus for the image bearing member-protecting agent illustrated in FIG. 2.
Figure 4:
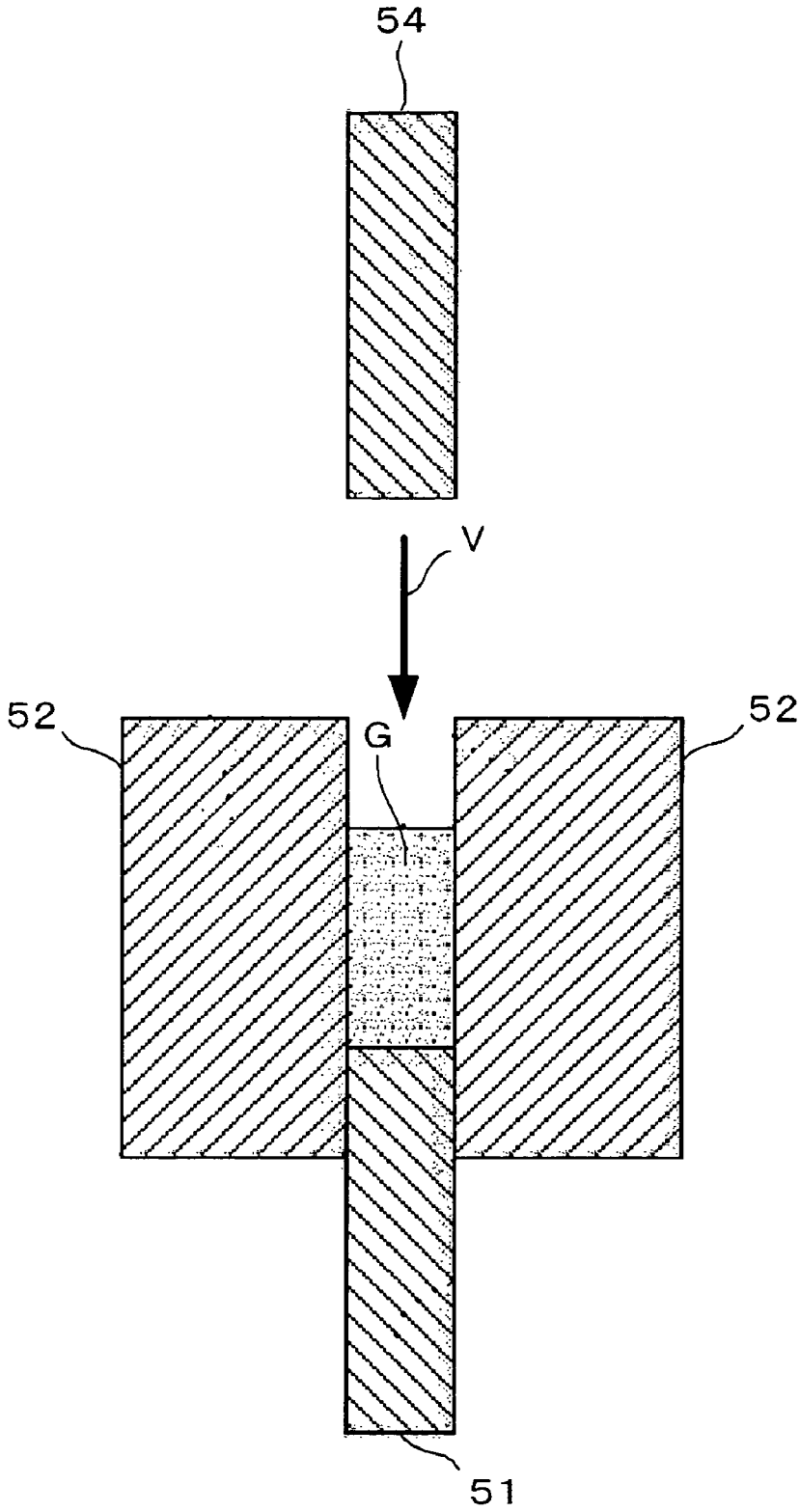
FIG. 4 is a sectional side view of the production apparatus illustrated in FIG. 3.
Figure 5:
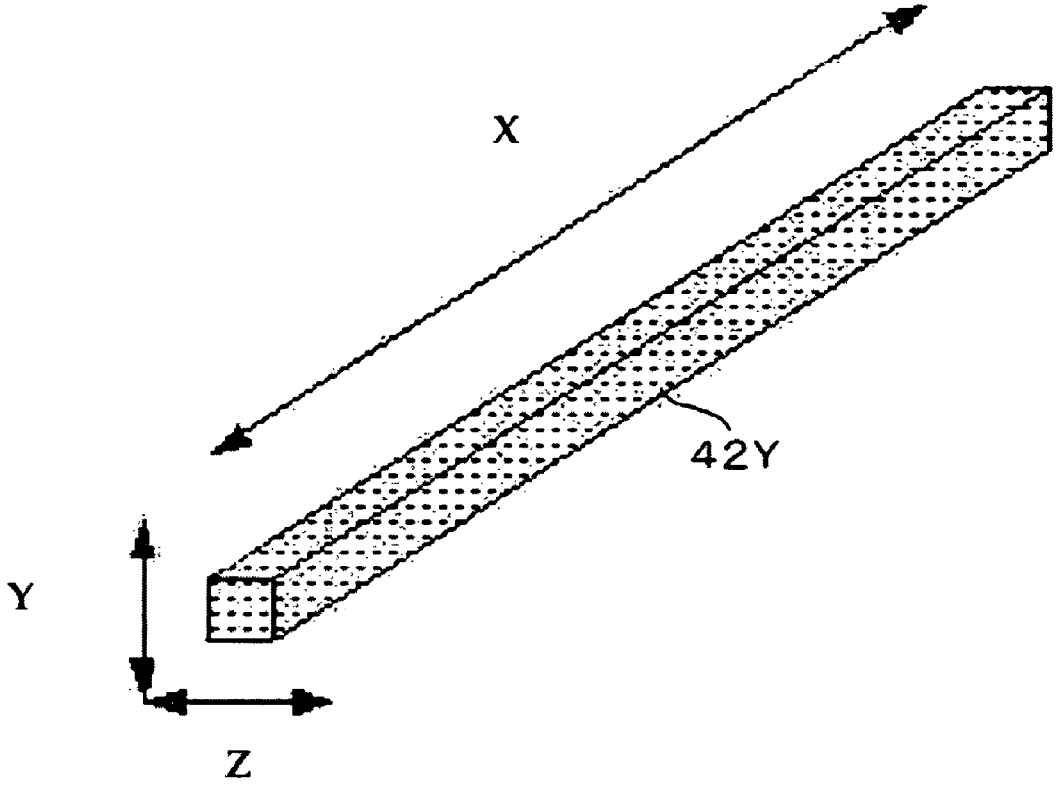
FIG. 5 is a perspective view of the image bearing member-protecting agent which is contained in the image forming apparatus illustrated in FIG. 2 and is produced by the production apparatus illustrated in FIGS. 3 and 4.

Referring now to FIGS. 3 to 5, description will be given with respect to an exemplary apparatus or method for producing the protecting agent 42Y. Notably, the apparatus or method for producing the protecting agent 42Y is the same as apparatuses or methods for producing protecting agents used in the protecting film-forming devices of the image forming units 68M, 68C and 68BK illustrated in FIG. 1. Thus, these apparatuses or methods for producing the protecting agents for the image forming units 68M, 68C and 68BK are not described below. The characters Y, M, C and BK after the reference numbers indicate that the corresponding members are respectively members for yellow, magenta, cyan and black.

As illustrated in FIGS. 3 and 4, a production apparatus 50 for the protecting agent 42Y has a lower mold 51, a pair of side molds 52, a pair of end molds 53, and an upper mold 54. In this production apparatus, the lower mold forms a surface of the protecting agent 42Y at the side where the protecting agent is supported by the holder 41Y. The side molds are disposed so as to sandwich the lower mold 51 and form side surfaces of the protecting agent 42Y extending in the longitudinal direction thereof. The end molds are disposed so as to sandwich the lower mold 51 and the side molds 52 and form end surfaces of the protecting agent 42Y in the longitudinal direction thereof. The upper mold forms a surface of the protecting agent 42Y at the side of the brush roller 47Y.

In FIG. 3, one of the end molds 53 is illustrated in an exploded manner. This end mold is actually disposed at a position facing the other end mold 53. During the below-described compression molding of the protecting agent 42Y, the end molds 53, the lower mold 51 and the side molds 52 define a partially confined space that opens in a direction in which the upper mold 54 enters the space. In a direction indicated by arrow V in FIGS. 3 and 4, the upper mold 54 moves to enter the partially confined space, whereby a completely confined space is formed by the upper mold 51, the side molds 52, the end molds 53 and the upper mold 54.

For producing the protecting agent 42Y, powder G containing zinc stearate and boron nitride (raw material) is charged into the partially confined space formed by the molds except for the upper mold 54. Specifically, first, powder G is uniformly charged into the partially confined space in the longitudinal direction corresponding to that of the protecting agent 42Y. Next, a small amount of powder G is charged into both end portions of the partially confined space. Here, the amount of powder G charged into one end portion is the same as that charged into the other end portion. Powder G may be powdered or granular, or be in a mixed state thereof.

After charging of powder G has been completed, the upper mold 54 is made to enter the partially confined space in the V direction, to thereby form a completely confined space while pressing. As a result, as illustrated in FIG. 5, the protecting agent 42Y satisfying the relationship $1.0<A/B<1.5$ is formed.

(Protecting Agent-Supplying Device)

A protecting agent-supplying device of the present invention (hereafter may be referred to as a "protecting film-forming device") includes at least the image bearing member-protecting agent and, if necessary, includes a supplying member, a layer-forming member and other members.

In an embodiment of the present invention, a protecting film-forming device 40Y (see FIG. 2) (serving as the above-described protecting agent-supplying device) has the protecting agent 42Y and the brush roller 47Y. The protecting agent is a solid lubricant molded so as to have a bar shape. The brush roller is a fur brush serving as a scraping member which is a supplying member scraping off and supplying, to the photoconductor drum 20Y, the protecting agent 42Y for protecting the photoconductor drum 20Y.

The protecting film-forming device 40Y also has a holder 41Y, a spring 48Y and a protecting layer-forming mechanism 49Y. Here, the holder supports the protecting agent 42Y at a surface facing the photoconductor drum 20Y and at the other surface. The spring is a pressing spring (press force-applying mechanism). The pressing spring is an elastic member which presses the protecting agent 42Y against the brush roller 47Y via the holder 41Y. The protecting layer-forming mechanism is for forming a protective film by coating the photoconductor drum 20Y with the protecting agent 42Y which has been supplied by the brush roller 47Y to the photoconductor drum 20Y.

Figure 2:
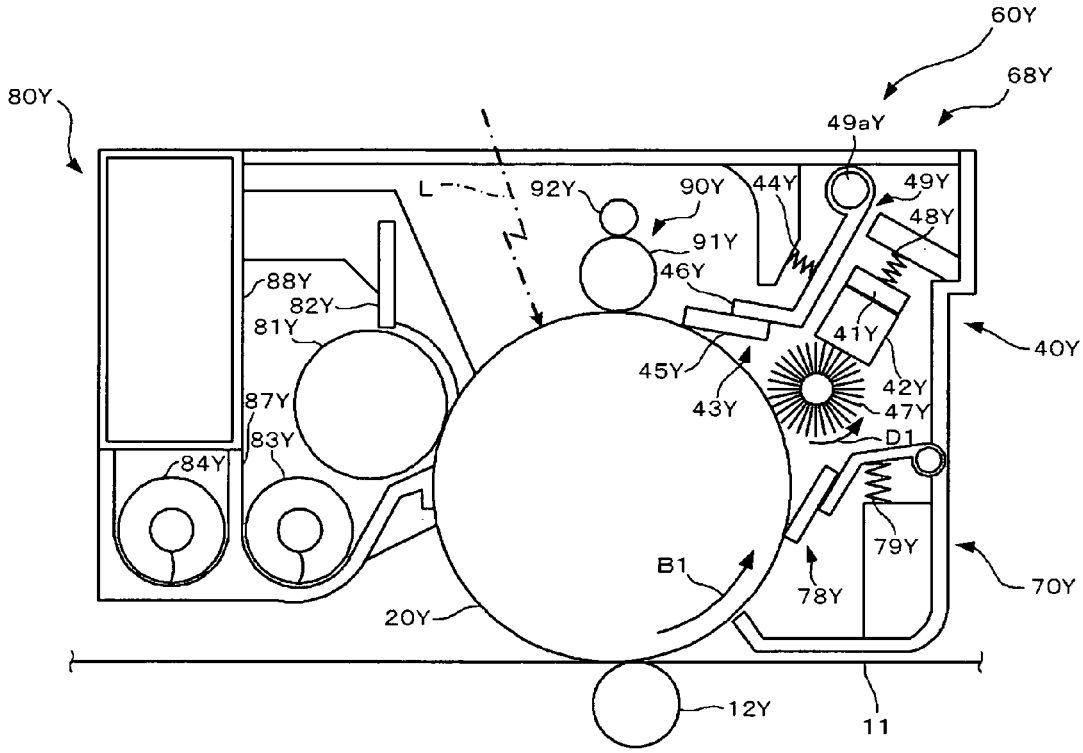
FIG. 2 is a schematic elevation of the configuration around one of the image bearing members contained in the image forming apparatus illustrated in FIG. 1.

In order for the protecting agent 42Y to be scraped off and consumed by the brush roller 47Y uniformly as a whole in the width direction, the protecting agent 42Y and the brush roller 47Y have the same length in the direction perpendicular to the front surface of FIG. 2 (i.e., in the width direction), and are disposed over the same region in the width direction. Also, the spring 48Y is adjusted so as to press the protecting agent 42Y against the brush roller 47Y at a constant press force over time and a uniform pressure in the longitudinal direction (see, for example, JP-A No. 2007-65100 regarding detail configuration).

The protecting agent 42Y and the brush roller 47Y each have a length (in the width direction) equal to or larger than the length (in the width direction) of the image forming region of the photoconductor drum 20Y. In the width direction, the protecting agent 42Y and the brush roller 47Y are disposed so as to contain the image forming region of the photoconductor drum 20Y. With this configuration, the protecting agent 42Y is supplied by the brush roller 47Y to the image forming region of the photoconductor drum 20Y uniformly in the width direction.

The protecting film-forming mechanism 49Y has a coating blade 43Y and a spring 44Y. The coating blade is a film-forming member (layer-forming member) which comes into contact with the photoconductor drum 20Y at the end thereof, to layer, on the photoconductor drum 20Y, the protecting agent 42Y supplied by the brush roller 47Y to the photoconductor drum 20Y. The spring is an elastic member which presses the coating blade 43Y against the photoconductor drum 20Y at a predetermined elastic force.

The coating blade 43Y has a blade 45Y and a blade support 46Y. The blade support comes into contact with the photoconductor drum 20Y. The blade support is rotatable around a support shaft 49*a*Y and supports the blade 45Y. Also, the blade support is pressed by the spring 44Y. The blade 45Y and the blade support 46Y are attached to each other through adhesion, in order to ensure pressing of the end of the blade 45Y against the photoconductor drum 20Y. Alternatively, these members may be attached to each other through any other means such as fusion.

The length (in the width direction) of the coating blade 43Y is equal to or larger than the length (in the width direction) of the image forming region of the photoconductor drum 20Y. The coating blade is disposed so as to contain the image forming region of the photoconductor drum 20Y. With this configuration, the coating blade 43Y uniformly comes into contact with at least the image forming region of the photoconductor drum 20Y in the width direction, and forms a uniform film on at least the image forming region of the photoconductor drum 20Y in the width direction.

The protecting film-forming device 40Y having the above-described configuration supplies the protecting agent 42Y to the photoconductor drum 20Y as follows. Specifically, the brush roller 47Y is rotated around the axis thereof at a predetermined linear velocity different from the rotation speed of the photoconductor drum 20Y in the direction indicated by D1, which is the counter direction with respect to the rotation direction B1 of the photoconductor drum 20Y. The brush roller scrapes off and holds/transfers the protecting agent 42Y to the position where the brush roller comes into contact with the surface of the photoconductor drum 20Y.

Although the protecting agent 42Y applied to the photoconductor drum 20Y may not form a sufficient protecting film on the photoconductor drum 20Y depending on the material of the protecting agent 42Y, the protecting agent is pressed by the coating blade 43Y against the surface of the photoconductor drum 20Y and is stretched thereon, whereby a thin layer (film) of the protecting agent is formed (in other words, the protecting agent is layered). In this manner, a film of the protecting agent is formed assuredly and uniformly.

Even when the protecting agent 42Y is scraped off by the brush roller 47Y and reduced over time (i.e., the protecting agent 42Y becomes small), the brush roller 47Y scrapes off and feeds an appropriate amount of the protecting agent to the photoconductor drum 20Y. This is because the spring 48Y uniformly presses the protecting agent 42Y against the brush roller 47Y at a constant pressure over time in the longitudinal direction, and the density of the protecting agent 42Y is controlled as described below.

The film of the protecting agent 42Y formed on the surface of the photoconductor drum 20Y has a function of preventing degradation of the surface of the photoconductor drum 20Y due to contact discharging. Thus, the protecting film-forming device 40Y serves as a unit configured to prevent degradation due to discharging. Here, "degradation" refers both to abrasion of the photoconductor drum 20Y due to discharging and acceleration of the abrasion, and to activation of the surface of the photoconductor drum 20Y.

Also, this film prevents degradation such as abrasion due to the friction between the photoconductor drum 20Y and the cleaning blade 78Y, and degradation due to filming (caused by the friction) on the surface of the photoconductor drum 20Y. Thus, the protecting film-forming device 40Y serves as a unit configured to prevent degradation due to friction.

As described above, the protecting film-forming device 40Y applies the protecting agent 42Y onto the surface of the photoconductor drum 20Y, to thereby prevent such degradations.

Other detail descriptions of the protecting film-forming device 40Y will be given below.

The protecting film-forming device 40Y will be described below. Notably, this protecting film-forming device has the same configuration as the other protecting film-forming devices contained in the image forming units 68M, 68C and 68BK. Thus, the description of the other protecting film-forming devices is omitted.

As described above, since the protecting film-forming device 40Y has the spring 48Y, the brush roller 47Y scrapes off and feeds an appropriate amount of the protecting agent 42Y to the photoconductor drum 20Y through contact therewith, even when the protecting agent 42Y is scraped off by the brush roller 47Y and reduced over time (i.e., the protecting agent becomes small).

Here, the protecting agent 42Y is a solid lubricant molded in the form of a bar as described above. Examples of known methods for forming the protecting agent 42Y so as to have a block shape include compression molding and melt molding. The lubricant obtained through melt molding is harder than that obtained through compression molding. Thus, the amount of the former lubricant supplied to the photoconductor drum 20Y is problematically decreased.

In particular, as revealed from the studies of the present inventors, the protecting agent 42Y, containing a fatty acid metal salt and an inorganic lubricant, is likely to raise this problem.

In view of this, for the purposes of, for example, ensuring the amount of the protecting agent 42Y supplied to the photoconductor drum 20Y, and elongating the service lives of the photoconductor drum 20Y, the cleaning blade 78Y and the charging roller 91Y, the protecting agent is a solid lubricant molded through compression molding so as to have a block shape.

However, the protecting agent molded through compression molding is generally soft. Thus, such a soft protecting agent is preferentially consumed from one side in the width direction thereof, resulting in that the protecting agent is not supplied to the photoconductor in a sufficient amount for a long period of time. In view of this, the image bearing member-protecting agent of the present invention is useful.

The material of the blade 45Y is not particularly limited. Examples of the material include elastic materials such as urethane rubber, hydrin rubber, silicone rubber and fluorine rubber, which are generally known as materials for cleaning blades. These elastic materials may be used individually or in a blended manner. Additionally, a portion of such a rubber blade which comes into contact with the photoconductor drum 20Y may be coated or impregnated with a low-friction-coefficient material. Further, in order to adjust the hardness of the elastic material used, a filling material such as an organic or inorganic filler may be dispersed.

Although the thickness of the blade 45Y cannot be unequivocally defined because the thickness is decided in view of the force applied by the spring 44Y, the blade preferably has a thickness of about 0.5 mm to about 5 mm, more preferably about 1 mm to about 3 mm.

Similarly, although the length of the blade 45Y which protrudes from the blade support 46Y and may bend (so-called free length) cannot be unequivocally defined because the length is decided in view of the force applied by the spring 44Y, the length is preferably about 1 mm to about 15 mm, more preferably about 2 mm to about 10 mm.

Another structure of the coating blade 43Y may be employed in which a layer of a resin, rubber, elastomer, etc. is formed over a surface of an elastic metal blade such as a spring plate, using a coupling agent, a primer component, etc. if necessary, by a method such as coating or dipping, then subjected to thermal curing, etc. if necessary, and further, subjected to surface polishing, etc. if necessary.

In this case, the thickness of the elastic metal blade is preferably about 0.05 mm to about 3 mm, more preferably about 0.1 mm to about 1 mm.

In order to prevent the elastic metal blade from being twisted, the blade may, for example, be bent in a direction substantially parallel to the support shaft 49*a*Y after the installation of the blade.

As the material for the layer over the surface, a fluorine resin such as PFA, PTFE, FEP or PVdF, a fluorine-based rubber, a silicone-based elastomer such as methylphenyl silicone elastomer, or the like may be used with the addition of a filler if necessary. However, the material is not limited thereto.

The force with which the photoconductor drum 20Y is pressed by the blade 45Y may be the force with which the protecting agent 42Y is spread and form into a protective layer or a protective film. The force is preferably 5 gf/cm to 80 gf/cm, more preferably 10 gf/cm to 60 gf/cm, as a linear pressure.

In order to reduce mechanical stress of the brush roller 47Y on the surface of the photoconductor drum 20Y, brush fibers of the brush roller preferably have flexibility.

As the material for the flexible brush fibers, one or more generally known materials may be used.

Examples of the material for the brush fibers include resins having flexibility among the following materials may be used: polyolefin resins (e.g., polyethylene and polypropylene); polyvinyl resins and polyvinylidene resins (e.g., polystyrene, acrylic resins, polyacrylonitrile, polyvinyl acetate, polyvinyl alcohol, polyvinyl butyral, polyvinyl chloride, polyvinyl carbazole, polyvinyl ethers and polyvinyl ketones); vinyl chloride-vinyl acetate copolymers; styrene-acrylic acid copolymers; styrene-butadiene resins; fluorine resins (e.g., polytetrafluoroethylene, polyvinyl fluoride, polyvinylidene fluoride and polychlorotrifluoroethylene); polyesters; nylons; acrylics; rayon; polyurethanes; polycarbonates; phenol resins; amino resins (e.g. urea-formaldehyde resins, melamine resins, benzoguanamine resins, urea resins and polyamide resins); and so forth.

To adjust the extent to which the brush bends, diene-based rubber, styrene-butadiene rubber (SBR), ethylene propylene rubber, isoprene rubber, nitrile rubber, urethane rubber, silicone rubber, hydrin rubber, norbornene rubber and the like may be used in combination.

The support immobilizing the brush fibers at their bases is a rotatable roll-like support. To form the brush roller 47Y, the rotatable roll-like support is spirally wound by a tape with a pile of brush fibers around a metal core. Notably, this support may be a stationary support.

Each brush fiber preferably has a diameter of about 10 μm to about 500 μm and a length of 1 mm to 15 mm, and the number of the brush fibers is preferably 10,000 to 300,000 per square inch ($1.5\times10^7$ to $4.5\times10^8$ per square meter).

For the brush roller 47Y, use of a material having a high brush fiber density is highly desirable in terms of uniformity and stability of the supply; for example, it is desirable that one fiber be formed from several to several hundreds of fine fibers. More specifically, 50 fine fibers of 6.7 decitex (6 denier) may be bundled together and planted as one fiber, as exemplified by the case of 333 decitex=6.7 decitex×50 filaments (300 denier=6 denier×50 filaments).

Additionally, if necessary, the surface of the brush roller 47Y may be provided with a coating layer for the purpose of stabilizing the shape of the brush surface, the environment, etc. As component(s) of the coating layer, use of component (s) capable of deforming in a manner that conforms to the bending of the brush fibers is preferable, and the component (s) is/are not limited in any way as long as it/they can maintain its/their flexibility. Examples of the component(s) include polyolefin resins such as polyethylene, polypropylene, chlorinated polyethylene and chlorosulfonated polyethylene; polyvinyl resins and polyvinylidene resins, such as polystyrene, acrylics (e.g., polymethyl methacrylate), polyacrylonitrile, polyvinyl acetate, polyvinyl alcohol, polyvinyl butyral, polyvinyl chloride, polyvinyl carbazole, polyvinyl ethers and polyvinyl ketones; vinyl chloride-vinyl acetate copolymers; silicone resins including organosiloxane bonds, and modified products thereof (e.g., modified products made of alkyd resins, polyester resins, epoxy resins, polyurethanes, etc.); fluorine resins such as perfluoroalkyl ethers, polyfluorovinyl, polyfluorovinylidene and polychlorotrifluoroethylene; polyamides; polyesters; polyurethanes; polycarbonates; amino resins such as urea-formaldehyde resins; epoxy resins; and combinations of these resins.

(Process Cartridge)

A process cartridge of the present invention includes at least a protecting agent-supplying device and an image bearing member; and, if necessary, further includes other units.

The protecting agent-supplying device contained in the process cartridge is the protecting agent-supplying device of the present invention.

The process cartridge is detachably mounted to the main body of the image forming apparatus of the present invention.

(Image Forming Apparatus)

An image forming apparatus of the present invention contains at least a protecting agent-supplying device and an image bearing member; and, if necessary, further includes other units.

The protecting agent-supplying device contained in the image forming apparatus is the protecting agent-supplying device of the present invention.

The image forming apparatus preferably contains the above-described process cartridge.

FIG. 1 schematically illustrates an image forming apparatus to which the present invention is applied. An image forming apparatus 100 is a complex machine of a color laser copier and a printer, but may be other image forming apparatuses such as other types of copiers, facsimiles, printers and complex machines thereof. The image forming apparatus 100 performs image forming processing on the basis of image signals corresponding to image data of an original document read by the image forming apparatus 100, or to image information the image forming apparatus 100 received from the outside. The image forming apparatus 100 can perform image formation on recording media (recording sheets) such as heavy paper (e.g., OHP sheets, cards and postcards) and mailing envelopes as well as plain paper commonly used in, for example, copying.

The image forming apparatus 100 employs a so-called tandem method based on a tandem structure, in which photoconductor drums (latent image bearing member) 20Y, 20M, 20C and 20BK are arranged in parallel. These photoconductor drums are image bearing members which are able to form images of colors of yellow, magenta, cyan and black.

The photoconductor drums 20Y, 20M, 20C and 20BK (the surfaces of these members are moved) are rotatably housed in an unillustrated frame of a main body 99 of the image forming apparatus 100, and arranged in this order along the direction indicated by arrow A1; i.e., the direction in which a transfer belt 11 (image bearing member (transfer medium)) is moved.

The photoconductor drums 20Y, 20M, 20C and 20BK are contained respectively in image forming units 68Y, 68M, 68C and 68BK, which forms images of yellow (Y), magenta (M), cyan (C) and black (BK).

The photoconductor drums 20Y, 20M, 20C and 20BK are located at the outer surface (i.e., at the side where images are to be formed) of the transfer belt 11 which is an intermediate transfer medium (member). The intermediate transfer medium is an endless belt which is disposed slightly above the center portion of the main body 99.

The transfer belt 11 can be moved along the direction indicated by arrow A1 with facing the photoconductor drums 20Y, 20M, 20C and 20BK. The visible images (toner images) formed on the photoconductor drums 20Y, 20M, 20C and 20BK are transferred in a superposed manner onto the transfer belt 11 moving along the A1 direction. After that, the composite image is transferred at one time onto an unillustrated recording paper (i.e., a transfer medium (a recording medium)).

The transfer belt 11 faces the photoconductor drums 20Y, 20M, 20C and 20BK at the upper side, and primary transfer portions 98 are formed between the transfer belt and the photoconductor drums. In the primary transfer portions, the toner images on the photoconductor drum 20Y, 20M, 20C and 20BK are transferred onto the transfer belt 11.

The toner images formed on the photoconductor drums 20Y, 20M, 20C and 20BK are transferred or superposed on the same position of the transfer belt 11, with the transfer belt 11 is being moved in the A1 direction. Specifically, primary transfer rollers 12Y, 12M, 12C and 12BK apply a voltage at different timings from upstream to downstream in the A1 direction so that the toner images are sequentially superposed on the same position of the transfer belt. The primary transfer rollers are disposed at positions facing the photoconductor drums 20Y, 20M, 20C and 20BK via the transfer belt 11.

The transfer belt 11 has a volume resistance (conductivity) of $10^5$ Ω·cm to $10^{11}$ Ω·cm. When the surface resistance is lower than $10^5$ Ω/sq., the toner images may be changed during discharge upon transfer of the toner image from the photoconductor drums 20Y, 20M, 20C and 20BK onto the transfer belt 11 (so-called toner scattering during transfer). When the surface resistance exceeds $10^{11}$ Ω/sq., the counter charges against the toner images remain on the transfer belt 11 after transfer of the toner images from the transfer belt 11 onto the recording paper, resulting in that an afterimage may be formed on the image obtained in the next cycle.

The transfer belt 11 may be, for example, a belt-shaped or cylindrical plastic, which is formed by extruding a kneaded product of a thermoplastic resin and a conductive polymer and/or conductive particles such as carbon black and metal oxides (e.g., tin oxide and indium oxide). Alternatively, the transfer belt 11 may be an endless belt which is formed through centrifugal molding under heating of a resin liquid containing a thermocrosslinkable monomer or oligomer and optionally containing the aforementioned conductive particles and/or conductive polymer.

When a surface layer is provided on the transfer belt 11, the surface layer may be made of the composition containing the materials (except for the charge transport material) for forming a surface layer of the below-described photoconductor drum 20Y. In this case, the composition may be appropriately changed in resistance with a conductive compound before use.

The transfer belt 11 has, at the edges, unillustrated skew-preventing guides serving as skew-preventing members. The skew-preventing guides are disposed for preventing the transfer belt 11 from skewing toward the back or the front of FIG. 1 during the rotation in the A1 direction. The skew-preventing guide is made of urethane rubber, and may also be made of other rubbers such as silicone rubber.

The image forming apparatus 100 includes, in the main body 99, four image forming units 68Y, 68M, 68C and 68BK, a transfer belt unit 10, a secondary transfer roller 5 and a light-scanning device 8. Here, the transfer belt unit is an intermediate transfer unit which has the transfer belt 11 and is disposed below the photoconductor drums 20Y, 20M, 20C and 20BK so as to face them. The secondary transfer roller is a secondary transfer bias roller (transfer member) which is disposed so as to face the transfer belt 11, and is moved and rotated correspondingly to the rotation of the transfer belt 11. The light-scanning device is a light-writing unit (latent image forming unit) which is disposed above the image forming units 68Y, 68M, 68C and 68BK so as to face them.

The image forming apparatus 100 also includes, in the main body 99, a sheet feeding device 61, a pair of registration rollers 4 and an unillustrated sensor. Here, the sheet-feeding device is a paper-feeding cassette (paper-feeding mechanism) capable of storing many sheets of recording, paper, which are conveyed to between the photoconductor drums 20Y, 20M, 20C and 20BK and the transfer belt 11. The registration rollers feed the recording paper sheet, which have been conveyed from the sheet-feeding device 61, to a secondary transfer portion 97 between the transfer belt 11 and the secondary transfer roller 5 at a predetermined timing corresponding to the toner image formation by the image forming units 68Y, 68M, 68C and 68BK. The unillustrated sensor detects that the top end of each recording paper sheet reached the registration rollers 4.

The image forming apparatus 100 also includes, in the main body 99, a fixing device 6, paper-discharging rollers 7 and a discharge tray 17. Here, the fixing device is a fixing unit in the belt-fixing method which is for fixing the transferred toner image on the recording paper sheet. The paper-discharging rollers are a pair of rollers for discharging the fixed recording paper sheet to the outside of the main body 99. The discharge tray 17 receives the recording paper sheets discharged by the discharging rollers 7 to the outside of the main body 99.

The image forming apparatus 100 also includes, above the main body 99, a reading device 14 and an automatic document feeder (i.e., ADF) 15. The reading device reads an image of the original document. The automatic document feeder is disposed above the reading device 14 and feeds the original document to the reading device 14.

The mage forming apparatus 100 also includes unillustrated driving devices, unillustrated power supply, unillustrated bias-controlling units and an unillustrated controlling unit. Here, the driving devices rotate the photoconductor drums 20Y, 20M, 20C and 20BK. The power supply and bias-controlling units are bias-applying units configured to apply secondary transfer bias to the secondary transfer roller 5. The controlling unit contains CPU, a memory, etc. and controls overall operation of the image forming apparatus 100 on the basis of, for example, the data detected by various detection units.

The transfer belt unit 10 includes, in addition to the transfer belt 11, primary transfer rollers 12Y, 12M, 12C and 12BK (primary transfer bias rollers), a drive roller 72 (driving member around which the transfer belt 11 is wound), a cleaning counter roller 74, supporting rollers 75 and 77 (which support the transfer belt 11 together with the drive roller 72 and the cleaning counter roller 74) and a cleaning device 13 (which is disposed so as to face the transfer belt 11 and cleans the transfer belt 11).

The transfer belt unit 10 also has an unillustrated driving system (by which the drive roller 72 is rotated) and an unillustrated power supply and unillustrated bias-controlling units (which are bias-applying units configured to apply primary transfer bias to the primary transfer rollers 12Y, 12M, 12C and 12BK).

The primary transfer rollers 12Y, 12M, 12C and 12BK press the back surface of the transfer belt 11 against the photoconductor drums 20Y, 20M, 20C and 20BK so as to form primary transfer nips.

Due to the primary transfer biases, a primary transfer electrical field is formed in the primary transfer nips between the photoconductor drums 20Y, 20M, 20C and 20BK and the primary transfer rollers 12Y, 12M, 12C and 12BK. The toner images of colors formed on the photoconductor drums 20Y, 20M, 20C and 20BK are primarily transferred onto the transfer belt 11 by virtue of the primary transfer electrical field and the nip pressure.

The drive roller 72 is disposed so as to come into contact with the secondary transfer roller 5 via the transfer belt 11, and forms a secondary transfer nip.

The supporting roller 75 serves as a tension roller (press member) which gives the transfer belt 11 a predetermined tension suitable for transfer.

The cleaning device 13 has a cleaning brush and a cleaning blade which are disposed so as to face and be in contact with the transfer belt 11 (detail illustration is omitted), and is configured to scrape off and remove foreign matter (e.g., residual toner particles) on the transfer belt 11 by the cleaning brush and the cleaning blade for cleaning the transfer belt 11.

The sheet-feeding device 61 accommodates many recording paper sheets in a stacked state (in bundle), and is disposed in multiple steps at the lower side of the main body 99. The sheet-feeding device 61 feeds paper sheets to a pair of registration rollers 4 at a predetermined timing.

The recording paper sheets, which have been fed from the sheet-feeding device 61, reach the registration rollers 4 through the paper-feeding pathway, and are sandwiched between the registration rollers 4.

The fixing device 6 has a belt unit 62 and a press roller 63 pressed against the belt unit 62. The belt unit 62 has an endless fixing belt 64, a fixing roller 65 (which moves the endless fixing belt 64 with supporting it) and a heating roller 66 (which has an unillustrated heat source therein and supports the endless fixing belt 64 together with the fixing roller 65).

The fixing device 6 fixes the toner image, by the action of heat and pressure, on the recording paper sheet which has fed to the fixing part (pressed portion) between the belt unit 62 and the press roller 63.

Next, description will be given with respect to the image forming unit 68Y, containing the photoconductor drum 20Y, among the image forming units 68Y, 68M, 68C and 68BK. Notably, since the configuration of the image forming unit 68Y is substantially the same as those of the other image forming units, detail descriptions thereof are appropriately omitted. Also, for the sake of convenience in the following description, the reference numerals of the constituent members of the image forming unit 68Y are used to denote the constituent members of the other image forming units, or are omitted.

As illustrated in FIG. 2, the image forming unit 68Y containing the photoconductor drum 20Y has, around the photoconductor drum 20Y, a primary transfer roller 12Y, a cleaning device 70Y (drum cleaning device serving as a cleaning unit), a protecting film-forming device 40Y (protecting agent-supplying device), an unillustrated charge-eliminating device, a charging device 90Y (serving as a charging unit) and a developing device 80Y (a developing device serving as a developing unit). These members are disposed so as to face the photoconductor drum 20Y along the B1 direction (in which the photoconductor drum 20Y is rotated); i.e., counterclockwise in the figure. The protecting film-forming device is a protecting agent-applying unit configured to apply a protecting agent 42Y (image bearing member-protecting agent) to the photoconductor drum 20Y. The charge-eliminating device has a charge-eliminating lamp.

The photoconductor drum 20Y, the cleaning device 70Y, the protecting film-forming device 40Y, the charge-eliminating device, the charging device 90Y and the developing device 80Y are integrally provided so as to form a process cartridge 60Y. The process cartridge 60Y is detachable to the main body 99. In this manner, when the members are provided in the form of the process cartridge which can be used as a replacement part, the maintenance thereof can be remarkably easily performed, which is quite preferred.

The photoconductor drum 20Y has a conductive support and a photoconductive layer thereon; i.e., an OPC photoconductor having an organic photoconductive layer. The detail description thereof will be given below.

The cleaning device 70Y has a cleaning blade 78Y, a spring 79Y and an unillustrated recovering chamber along the direction indicated by arrow B1. The cleaning blade is a cleaning member which is disposed downstream of the position where the toner image on the photoconductor drum 20Y is transferred onto the transfer belt 11 by the primary transfer roller 12Y but upstream of the position where a protecting agent 42Y is supplied from the protecting film-forming device 40Y. The tip of the cleaning blade is brought into contact with the photoconductor drum 20Y so as to scrape off (remove) toner particles remaining after transfer on the photoconductor drum 20Y and foreign matters (e.g., carriers and paper dust) thereon for cleaning. The spring causes the cleaning blade to be pressed against the photoconductor drum 20Y using a predetermined elastic force. The recovering chamber recovers the post-transfer residual toner particles or other foreign matters which have been removed by the cleaning blade 78Y from the photoconductor drum 20Y.

The cleaning blade 78Y is brought into contact with the photoconductor drum 20Y at an angle related to a so-called counter type (reading type).

The charging device 90Y is a charging unit configured to uniformly charge a surface of the photoconductor drum 20Y. The charging device 90Y has a charging roller 91Y, a cleaning roller 92Y and an unillustrated high-voltage power source. The charging roller is a charging member which is disposed closely to the surface of the photoconductor drum 20Y. The cleaning roller is disposed so as to come into contact with the charging roller 91Y, and cleans the charging roller 91Y. The high-voltage power source is a voltage-applying unit configured to apply to the charging roller 91Y a voltage which is formed by superposing a direct-current voltage on an alternating-current voltage, so that the voltage contains a direct-current component and an alternating-current component.

The method of charging the photoconductor drum 20Y may be, for example, a method by charging the photoconductor drum using the charging roller 91Y disposed close to the photoconductor drum 20Y (close-contact charging method) (like the charging device 90Y in this embodiment) and a method by charging the photoconductor drum using such a charging member as the charging roller 91Y disposed so as to come into contact with the photoconductor drum 20Y (contact-charging method (contact method)). The high-voltage power supply may be that applying only a direct-current voltage to the charging roller 91Y.

The charging device 90Y charges the photoconductor drum 20Y through discharge within a small gap between the charging roller 91Y and the photoconductor drum 20Y upon application of voltage with the high-voltage power supply. As compared with dischargers based on corona discharge using a discharging wire (e.g., so-called corotron and scorotron), the above charging method considerably reduces the amount of ozone generated during charging.

The light-scanning device 8 writes a latent electrostatic image in response to image information of a visible yellow image to be formed by the developing device 80Y. To form the latent electrostatic image, the light-scanning device applies modulated/polarized laser light L to a region between the charging region (where the charging device 90Y faces the photoconductor drum 20Y) and the developing region (where the developing device 80Y faces the photoconductor drum), to thereby expose, through spot irradiation, the surface of the photoconductor drum 20Y having been charged by the charging device 90Y. The light-scanning device 8, as illustrated in FIG. 1, has a light source 31, a polygon mirror 32 (which is a polygon column rotating at high speed), a lens fθ 33, a reflective mirror 34, etc.

As illustrated in FIG. 2, the developing device 80Y has a developing roller 81Y (which is disposed close to the photoconductor drum 20Y so as to face the photoconductor drum), a doctor blade 82Y (which adjusts the thickness of the developer on the developing roller 81Y to a certain thickness), a first feeding screw 83Y and a second feeding screw 84Y (which are disposed so as to face each other and stir and feed a developer to the developing roller 81Y), a partition wall 87Y (which is disposed between the first feeding screw 83Y and the second feeding screw 84Y), a toner bottle 88Y containing yellow toner, an unillustrated bias-applying unit (which is configured to apply to the developing roller 81Y a developing bias of direct-current component).

The developing roller 81Y has an unillustrated developing sleeve which is a developer carrier carrying a developer on a surface thereof. The bias-applying unit is configured to apply, to the developing sleeve, an appropriate amount of a developing bias corresponding to the difference between exposed portions and unexposed portions on the photoconductor drum 20Y.

The developing device 80Y is divided by a partition wall 87Y into a first feeding part and a second feeding part. The first feeding part houses the developing roller 81Y and the first feeding screw 83Y. The second feeding screw houses the second feeding screw 84Y.

While being rotated with a driving unit, the first feeding screw 83Y feeds the developer contained in the first feeding part to the developing roller 81Y from the back to the front of FIG. 2. The developer is fed by the first feeding screw 83Y to the position near the edge of the first feeding part, and then, enters the second feeding part through an unillustrated opening formed in the partition wall 87Y.

In the second feeding part, the second feeding screw 84Y feeds the developer, which has been fed from the first feeding part by the first feeding screw being rotated with the driving unit, in a direction opposite to the direction in which the developer is fed by the first feeding screw 83Y. The developer is fed to a position near the edge of the second feeding part by the second feeding screw 84Y, and then, is returned to the first feeding part through another unillustrated opening formed in the partition wall 87Y.

The developer contained in an unillustrated developer case is a two-component developer containing magnetic carriers and yellow toner particles. The yellow toner particles are added/supplied from the toner bottle 88Y to the developer. The thus-supplied yellow toner particles and the developer are transferred under mixing/stirring by the first feeding screw 83Y and the second feeding screw 84Y. As a result, the toner particles and the developer are frictionally charged and fed/carried onto the developing roller 81Y.

The developing roller 81Y, after the amount of the developer carried thereon (the thickness of a layer of the developer) has been controlled by the doctor blade 82Y, conveys an appropriate amount of the developer to the developing region between the developing roller 81Y and the photoconductor drum 20Y in accordance with the rotation thereof. Then, through the application of developing bias generated by the bias-applying unit, the yellow toner particles contained in the developer are electrically transferred onto a latent electrostatic image formed on the photoconductor drum 20Y, to thereby form a yellow toner image corresponding to the latent electrostatic image.

The developer in which the yellow toner has been consumed after development is returned to the developing device 80Y in accordance with the rotation of the developing roller 81Y.

In this embodiment, a developing bias of direct-current component is applied with the bias-applying unit. But, the developing bias may be an alternating current component or a superposed direct-current component/alternating current component.

In the above-described image forming unit 68Y, image formation is performed through a nega-posi process. While the photoconductor drum 20Y is being rotated in the B1 direction, the surface thereof is uniformly negative-charged by the charging device 90Y. Then, the surface is scanned by/exposed to laser light L emitted from the light-scanning device 8 to form a latent electrostatic image of yellow. In this state, the photoconductor drum 20Y is scanned/exposed along the rotation axis thereof. Also, the absolute value of the potential at the exposed portion is lower than the absolute value of the potential at the unexposed portion.

The latent electrostatic image is developed by the developing device 80Y with yellow toner contained in the developer. The yellow toner image obtained after development is primarily transferred by the primary transfer roller 12Y onto the transfer belt 11 moving in the A1 direction. The post-transfer toner particles (remaining after transfer) are removed by the cleaning device 70Y. Then, the protecting film-forming device 40Y feeds the protecting agent 42Y. After that, the residual charges are eliminated by the charge-eliminating device. The photoconductor drum is subjected to the next charging (charge-eliminating) by the charging device 90Y.

In this state, the cleaning device 70Y removes the partially or entirely degraded protecting agent on the photoconductor drum 20Y, in addition to other matters such as post-transfer residual toner particles.

The protecting film-forming device 40Y forms a protecting film of the protecting agent on the surface of the photoconductor drum 20Y having undergone cleaning.

The cleaning device 70Y may be omitted by imparting its function (cleaning function) to the protecting layer-forming mechanism 49Y or the coating blade 43Y contained therein.

However, a member having the function of cleaning the photoconductor drum 20Y and a member having the function of forming a protective layer are different in material, required press force (against the photoconductor drum 20Y) and preferable contact state (with the photoconductor drum 20Y). Thus, as in this embodiment, preferably, these members are provided as separate members rather than as a single member. Specifically, in the B1 direction, the cleaning device 70Y is disposed upstream and the protecting layer-forming mechanism 49Y is disposed downstream, which is a preferred embodiment. Notably, also in this embodiment, since the cleaning device 70Y cleans the protecting agent on the surface of the photoconductor drum 20Y, the cleaning device is regarded as a protecting agent-cleaning mechanism, which is a protecting agent-cleaning unit contained in the protecting film-forming device 40Y.

Similarly, toner images of the other colors are correspondingly formed on the other photoconductor drums 20M, 20C and 20BK, and then primarily transferred sequentially by the primary transfer rollers 12M, 12C and 12BK onto the same position of the transfer belt 11 moving in the A1 direction. While the transfer belt 11 is rotated in the A1 direction, the composite toner image formed on the transfer belt 11 is moved to the secondary transfer nip where the secondary transfer roller 5 faces the transfer belt. In this nip, the composite image adheres closely to a recording paper, and is secondarily transferred thereonto by the secondary transfer bias or the nip pressure, whereby a full color image is formed on the recording paper.

After has been fed to between the transfer belt 11 and the secondary transfer roller 5, the recording paper is fed by a paper-feeding roller 3 from the sheet-feeding device 61. Then, based on detection signals obtained by the sensor, the recording paper is fed by the registration rollers 4 at the timing when the top end of the toner image on the transfer belt 11 faces the secondary transfer roller 5.

With the bias-applying unit, a potential having the opposite polarity to that of the toner is applied to the secondary transfer roller 5.

The toner images of all colors are transferred/carried onto the recording paper. Then, the recording paper enters the fixing device 6 where the toner image is fixed thereon by the action of heat and pressure applied when the recording paper passes between the press roller 63 and the belt unit 62, whereby a full color image is fixed on the recording paper. The fixed recording paper, having passed through the fixing device 6, passes between the discharging rollers 7 and is stacked on the discharge tray 17 located above the main body 99. The surface of the transfer belt 11, having passed through the secondary transfer nip after secondary transfer, is cleaned by a cleaning brush and a cleaning blade equipped with the cleaning device 13 for the next developing step.

The configuration of the photoconductor drum 20Y will be described in detail below. Notably, this photoconductor drum has the same configuration as the other photoconductor drums 20M, 20C and 20BK contained in the image forming units 68M, 68C and 68BK. Thus, the description of the other photoconductor drums 20M, 20C and 20BK is omitted.

The photoconductor drum 20Y includes a conductive support, and a photoconductive layer provided on the conductive support.

The structure of the photosensitive layer is selected from a single-layer structure in which a charge generating material and a charge transporting material are present in a mixed manner, a normal layer structure in which a charge transporting layer is provided on a charge generating layer, and an inverted layer structure in which a charge generating layer is provided on a charge transporting layer.

Additionally, a protecting layer (surface layer) may be provided on the photosensitive layer as the uppermost surface, in order to improve the mechanical strength, abrasion resistance, gas resistance, cleanability, etc. of the photoconductor drum 20Y. Further, an underlying layer may be provided between the photoconductive layer and the conductive support. Also, if necessary, an appropriate amount of a plasticizer, an antioxidant, a leveling agent, etc. may be added to each layer.

As the conductive support, what can be used is a material exhibiting conductivity of $10^{10}$ Ω·cm or less in volume resistance. Examples thereof include a construction formed by coating a film-like or cylindrical piece of plastic or paper with a metal such as aluminum, nickel, chrome, Nichrome, copper, gold, silver or platinum or with a metal oxide such as tin oxide or indium oxide by means of vapor deposition or sputtering; a plate of aluminum, aluminum alloy, nickel, stainless, etc.; and a tube produced by forming the plate into a drum-shaped mother tube by means of drawing, extrusion, etc. and then surface-treating the mother tube by means of cutting, superfinishing, polishing, etc.

The conductive support has a drum shape whose diameter is 20 mm to 150 mm, preferably 24 mm to 100 mm, more preferably 28 mm to 70 mm. If the drum-shaped conductive support has a diameter of 20 mm or less, it is physically difficult to place, around the photoconductor drum 20Y, members for the steps of charging, exposing, developing, transferring and cleaning. If the drum-shaped conductive support has a diameter of 150 mm or greater, it is undesirable because the image forming apparatus 100 is enlarged.

Particularly in the case where an image forming apparatus is of tandem type like the image forming apparatus 100 which is one embodiment of the present embodiment, it is necessary to install a plurality of photoconductor drums therein, so that the diameter of the support of each photoconductor drum is preferably 70 mm or less, more preferably 60 mm or less. Parenthetically, the endless nickel belt and the endless stainless steel belt disclosed in JP-A No. 52-36016 can be used as conductive supports.

Examples of the underlying layer of the photoconductor drum include a layer composed mainly of resin, a layer composed mainly of white pigment and resin, and an oxidized metal film obtained by chemically or electrochemically oxidizing the surface of a conductive support, with a layer composed mainly of white pigment and resin being preferred.

Examples of the white pigment include metal oxides such as titanium oxide, aluminum oxide, zirconium oxide and zinc oxide. Among them, it is most desirable to use titanium oxide that is superior in preventing penetration of electric charge from the conductive support. Examples of the resin used for the underlying layer include thermoplastic resins such as polyamide, polyvinyl alcohol, casein and methyl cellulose, and thermosetting resins such as acrylics, phenol resins, melamine resins, alkyds, unsaturated polyesters and epoxies. These may be used individually or in combination.

Examples of the charge generating material include azo pigments such as monoazo pigments, bisazo pigments, trisazo pigments and tetrakisazo pigments; organic pigments and dyes such as triarylmethane dyes, thiazine dyes, oxazine dyes, xanthene dyes, cyanine pigments, styryl pigments, pyrylium dyes, quinacridone pigments, indigo pigments, perylene pigments, polycyclic quinone pigments, bisbenzimidazole pigments, indanthrone pigments, squarylium pigments and phthalocyanine pigments; and inorganic materials such as selenium, selenium-arsenic, selenium-tellurium, cadmium sulfide, zinc oxide, titanium oxide and amorphous silicon. These may be used individually or in combination. The underlying layer may have a single-layer structure or a multilayer structure.

Examples of the charge transporting material include anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives and triphenylmethane derivatives. These may be used individually or in combination.

Binder resin(s) used in forming the photoconductive layer composed of the charge generating layer and the charge transporting layer is/are electrically insulative and may be selected from known thermoplastic resins, thermosetting resins, photocurable resins, photoconductive resins and the like. Suitable examples thereof include, but not limited to, thermoplastic resins such as polyvinyl chloride, polyvinylidene chloride, vinyl chloride-vinyl acetate copolymers, vinyl chloride-vinyl acetate-maleic anhydride copolymers, ethylene-vinyl acetate copolymers, polyvinyl butyral, polyvinyl acetal, polyesters, phenoxy resins, (meth)acrylic resins, polystyrene, polycarbonates, polyarylate, polysulphone, polyethersulphone and ABS resins; thermosetting resins such as phenol resins, epoxy resins, urethane resins, melamine resins, isocyanate resins, alkyd resins, silicone resins and thermosetting acrylic resins; and photoconductive resins such as polyvinylcarbazole, polyvinylanthracene and polyvinylpyrene. These may be used individually or in combination.

Examples of the antioxidant include the following compounds.

[Monophenolic Compounds]

2,6-di-t-butyl-p-cresol, butylated hydroxyanisole, 2,6-di-t-butyl-4-ethylphenol, stearyl-β-(3,5-di-t-butyl-4-hydroxyphenyl)propionate, 3-t-butyl-4-hydroxyanisole and so forth

[Bisphenolic Compounds]

2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol) and so forth

[Polymeric Phenolic Compounds]

1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butylic acid]glycol ester, tocophenols and so forth

[p-Phenylenediamines]

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine and so forth

[Hydroquinones]

2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and so forth

[Organic Sulfur Compounds]

dilauryl-3,3'-thiodipropionate, distearyl-3,3'-thiodipropionate, ditetradecyl-3,3'-thiodipropionate and so forth

[Organic Phosphorus Compounds]

triphenylphosphine, tri(nonylphenyl)phosphine, tri(dinonylphenyl)phosphine, tricresylphosphine, tri(2,4-dibutylphenoxy)phosphine and so forth For the plasticizer, a resin such as dibutyl phthalate or dioctyl phthalate generally used as a plasticizer can be used. It is appropriate that the amount of the plasticizer used be 0 parts by mass to 30 parts by mass per 100 parts by mass of the binder resin.

A leveling agent may be added into the charge transporting layer. Examples of the leveling agent include silicone oils such as dimethyl silicone oil and methylphenyl silicone oil; and polymers or oligomers having perfluoroalkyl groups in their side chains. It is appropriate that the amount of the leveling agent used be 0 parts by mass to 1 part by mass per 100 parts by mass of the binder resin.

As described above, the surface layer is provided in order to improve the mechanical strength, abrasion resistance, gas resistance, cleanability, etc. of the photoconductor drum 20Y. Examples of the material for the surface layer include a polymer, and a polymer with an inorganic filler dispersed therein, both of which have greater mechanical strength than the photosensitive layer. The polymer used for the surface layer may be a thermoplastic polymer or a thermosetting polymer, with a thermosetting polymer being preferred because it has high mechanical strength and is highly capable of reducing abrasion caused by friction with a cleaning blade. For this reason, the surface layer in this embodiment preferably contains a thermosetting polymer (heat-curable polymer). As long as the surface layer is thin, there may be no problem if it does not have charge transporting capability. However, when a surface layer not having charge transporting capability is formed so as to be thick, the photoconductor is easily caused to decrease in sensitivity, increase in electric potential after exposure, and increase in residual potential, so that it is desirable to mix the above-mentioned charge transporting material into the surface layer or use a polymer with charge transporting capability for the protecting layer (surface layer).

Generally, the photosensitive layer and the surface layer greatly differ from each other in mechanical strength, so that once the protecting layer (surface layer) is abraded due to friction with the cleaning blade 78Y and thusly disappears, the photosensitive layer is also abraded. Therefore, when the surface layer is provided, it is important to make it have a sufficient thickness. The thickness of the surface layer is 0.01 μm to 12 μm, preferably 1 μm to 10 μm, more preferably 2 μm to 8 μm. If the thickness of the surface layer is less than 0.01 μm, it is not desirable because the surface layer is so thin that parts of the surface layer easily disappear due to friction with the cleaning blade 78Y, and abrasion of the photosensitive layer progresses through the missing parts. If the thickness of the surface layer is greater than 12 μm, it is not desirable because the photoconductor is easily caused to decrease in sensitivity, increase in electric potential after exposure, and increase in residual potential and, especially when a polymer with charge transporting capability is used, the cost of the polymer increases.

As the polymer used for the surface layer, a polymer which is transparent to writing light at the time of image formation and superior in insulation, mechanical strength and adhesiveness is desirable. Examples thereof include resins such as ABS resins, ACS resins, olefin-vinyl monomer copolymers, chlorinated polyethers, allyl resins, phenol resins, polyacetals, polyamides, polyamide-imides, polyacrylates, polyallylsulfones, polybutylene, polybutylene terephthalate, polycarbonates, polyethersulfones, polyethylene, polyethylene terephthalate, polyimides, acrylic resins, polymethylpentene, polypropylene, polyphenylene oxide, polysulfones, polystyrene, AS resins, butadiene-styrene copolymers, polyurethanes, polyvinyl chloride, polyvinylidene chloride and epoxy resins. The polymer exemplified by these may be a thermoplastic polymer; however, when a thermosetting polymer produced by cross-linkage with a multifunctional cross-linking agent having an acryloyl group, carboxyl group, hydroxyl group, amino group, etc. is used as the polymer to enhance its mechanical strength, the surface layer increases in mechanical strength and it becomes possible to greatly reduce abrasion caused by friction with the cleaning blade, which is preferred.

As described above, the surface layer preferably has charge transporting capability. In order for the surface layer to have charge transporting capability, it is possible to employ a method in which a polymer used for the surface layer and the aforementioned charge transporting material are mixed together, or a method in which a polymer having charge transporting capability is used as the surface layer, with the latter method being preferable because a photoconductor which is highly sensitive and does not increase much in electric potential after exposure or in residual potential can be obtained.

A cleanability improver may be used to remove the developer after transfer remaining on the photoconductor drums 20Y, 20M, 20C and 20BK or the transfer belt 11. Examples of the cleanability improver include fatty acid metal salts (e.g., zinc stearate and calcium stearate) and polymer microparticles produced through soap-free emulsion polymerization (e.g., polymethyl methacrylate microparticles and polystyrene microparticles). The polymer microparticles preferably have a relatively narrow particle size distribution, and have a volume average particle diameter of 0.01 μm to 1 μm.

After transfer, some of the toner particles remaining on the transfer belt 11 or the photoconductor drums 20Y, 20M, 20C and 20BK disadvantageously are not removed by, for example, the cleaning device 13 and the cleaning device 70Y to run through these cleaning devices, since the toner particles are fine particles and have good rolling property. Thus, in order to completely remove toner particles from the transfer belt 11 or the photoconductor drums 20Y, 20M, 20C and 20BK, for example, such a toner-removing member as the cleaning blade 78Y must be strongly pressed against the transfer belt 11 or the photoconductor drums 20Y, 20M, 20C and 20BK. Such a load may shorten service lives of, for example, the transfer belt 11, the photoconductor drums 20Y, 20M, 20C and 20BK, the cleaning device 13 and the cleaning device 70Y, and also require extra energy, which is disadvantageous.

In reducing the load applied to the transfer belt 11 or the photoconductor drums 20Y, 20M, 20C and 20BK, the remaining toner particles or carriers with a small diameter are not sufficiently removed from the transfer belt 11 or the photoconductor drums 20Y, 20M, 20C and 20BK. These toner particles or carriers pass through, for example, the cleaning device 13 and the cleaning device 70Y, and damage the surfaces of the transfer belt 11 or the photoconductor drums 20Y, 20M, 20C and 20BK, causing changes in performance of the image forming apparatus 100.

As described above, in the image forming apparatus 100, the photoconductor drums 20Y, 20M, 20C and 20BK are hardly changed in surface conditions, in particular, are highly resistant to the presence of low resistant portions. That is, changes in chargeability, etc. of the photoconductor drums 20Y, 20M, 20C and 20BK are highly suppressed. When the above-described toner particles are used in this image forming apparatus, remarkably high-quality images can be consistently formed for a long period of time.

The image forming apparatus 100 may be used in combination not only with toner particles suitable for forming high-quality images, but also with amorphous toner particles produced by a pulverization method. Needless to say, the service life of the apparatus is elongated considerably.

The materials used for such pulverized toner particles are not particularly limited and may be those generally used for electrophotographic toner particles.

Examples of generally used binder resins for the pulverized toner particles include, but are not limited to, polymers of styrene or a substituted product thereof (e.g., polystyrene, poly-p-chlorostyrene and polyvinyltoluene), styrene copolymers (e.g., styrene/p-chlorostyrene copolymers, styrene/propylene copolymers, styrene/vinyltoluene copolymers, styrene/vinyl naphthalene copolymers, styrene/methyl acrylate copolymers, styrene/ethyl acrylate copolymers, styrene/butyl acrylate copolymers, styrene/octyl acrylate copolymers, styrene/methyl methacrylate copolymers, styrene/ethyl methacrylate copolymers, styrene/butyl methacrylate copolymers, styrene/methyl α-chloromethacrylate copolymers, styrene/acrylonitrile copolymers, styrene/vinyl methyl ketone copolymers, styrene/butadiene copolymers, styrene/isoprene copolymers and styrene/maleic acid copolymers), acrylic acid ester monomers or copolymers thereof (e.g., polymethyl acrylates, polybutyl acrylates, polymethyl methacrylates and polybutyl methacrylates), polyvinyl derivatives (e.g., polyvinyl chlorides and polyvinyl acetates), polyester polymers, polyurethane polymers, polyamide polymers, polyimide polymers, polyol polymers, epoxy polymers, terpene polymers, aliphatic or alicyclic hydrocarbon resins, and aromatic petroleum resins. These may be used individually or in combination. In particular, at least one of styrene-acrylic copolymers, polyester resins and polyol resins is more preferred from the viewpoints of, for example, obtaining desired electrical characteristics and reducing cost. Furthermore, use of polyester resins and/or polyol resins is still more preferred, since they have excellent fixing property.

For the above-described reasons, preferably, the resin components contained in the coating layer of a charging member such as the charging roller 91Y are, as the same resin components as the binder resins of the toner, at least one of linear polyester resin compositions, linear polyol resin compositions, linear styrene acrylic resin compositions and crosslinked products thereof.

The toner produced by a pulverization method may be produced from the above-described resin components as well as the above-described colorant components, wax components and charge-controlling components. Specifically, these components are optionally pre-mixed with one another, and kneaded at a temperature near and lower than the melting temperature the resin component. After has been cooled, the kneaded product is subjected to a pulverization/classification step. In addition, the above-described external components may be appropriately added to/mixed with the resultant toner, if necessary.

(Image Forming Method)

An image forming method of the present invention performs image formation with the above-described image forming apparatus.

EXAMPLES

Examples

The present invention will next be described in more detail by way of Examples, which should not be construed as limiting the present invention thereto.

(Usage Environment of Image Bearing Member-Protecting Agent)

In the image forming part of IMAGIO MP C5000 (product of Ricoh, Company Ltd.), each of the image bearing member-protecting agents in Examples and Comparative Examples given below was supplied, instead of zinc stearate originally used in the apparatus, from a portion for the supply of zinc stearate.

This IMAGIO MP C5000 (product of Ricoh, Company Ltd.) has such a configuration that an image bearing member-protecting agent is uniformly pressed at a constant pressure against a brush roller in the longitudinal direction thereof for a long period of time (see, for example, JP-A No. 2007-65100 regarding detail configuration), as a press mechanism in which a protecting agent of zinc stearate originally provided in the apparatus is pressed against a brush roller. This configuration is the same as that of the image forming apparatus 100.

(Usage Conditions of Image Bearing Member-Protecting Agent)

Three hundred thousand A4 size paper sheets each having an image occupation rate of 5% were printed out for the test.

The longitudinal length of each image bearing member-protecting agent was 30 cm. Each of the end portions thereof was 3 cm, and the central portion thereof was 10 cm.

(Production Conditions of Image Bearing Member-Protecting Agent)

In each of Examples and Comparative Examples, an image bearing member-protecting agent was formed under the following production conditions.

A cuboid image bearing member-protecting agent (10 mm×21 mm×300 mm (longitudinal length)) was formed.

When the image bearing member-protecting agent was formed through compression molding, a predetermined amount of raw materials (amount of raw materials uniformly charged) was charged into a mold and leveled, and then, a predetermined amount of raw materials (total amount of raw materials additionally charged in both ends) was additionally charged in both ends of the mold, followed by compression molding. Tables 1-1 and 1-2 show the amount of raw materials uniformly charged and the total amount of raw materials additionally charged in both ends in each of Examples and Comparative Examples. Note that the amount of raw materials additionally charged in one end is half of the total amount of raw materials additionally charged in both ends.

In compression molding conducted for forming the image bearing member-protecting agent, the pressure was adjusted to 130 kN and the compression time was adjusted to 10 sec.

The density of the image bearing member-protecting agent was measured with an X ray analytical microscope (XGT-2000W, product of HORIBA, Ltd.) and based on the intensity of X rays transmitting the image bearing member-protecting agent. Tables 1-1 and 1-2 show density A, density B and the ratio A/B in each of Examples and Comparative Examples.

Example 1

An image bearing member-protecting agent used was formed through compression molding of a mixture of a fatty acid metal salt and an inorganic lubricant in the ratio by mass of 8:2. The fatty acid metal salt was zinc stearate (GF-200, product of NOF CORPORATION), and the inorganic lubricant was boron nitride (NX5, product of Momentive Performance Materials Inc.). In this image bearing member-protecting agent, density A at the end portions thereof was 0.5% higher than density B at the central portion thereof.

Example 2

An image bearing member-protecting agent used was formed through compression molding of a mixture of a fatty acid metal salt and an inorganic lubricant in the ratio by mass of 8:2. The fatty acid metal salt was zinc stearate (GF-200, product of NOF CORPORATION), and the inorganic lubricant was boron nitride (NX5, product of Momentive Performance Materials Inc.). In this image bearing member-protecting agent, density A at the end portions thereof was 5% higher than density B at the central portion thereof.

Example 3

An image bearing member-protecting agent used was formed through compression molding of a mixture of a fatty acid metal salt and an inorganic lubricant in the ratio by mass of 8:2. The fatty acid metal salt was calcium stearate (product of Wako Pure Chemical Industries, Ltd.), and the inorganic lubricant was boron nitride (NX5, product of Momentive Performance Materials Inc.). In this image bearing member-protecting agent, density A at the end portions thereof was 0.5% higher than density B at the central portion thereof.

Example 4

An image bearing member-protecting agent used was formed through compression molding of a mixture of a fatty acid metal salt and an inorganic lubricant in the ratio by mass of 8:2. The fatty acid metal salt was zinc stearate (GF-200, product of NOF CORPORATION), and the inorganic lubricant was mica (product of Shiseido Co., Ltd.). In this image bearing member-protecting agent, density A at the end portions thereof was 0.5% higher than density B at the central portion thereof.

Example 5

An image bearing member-protecting agent used was formed through compression molding of a mixture of a fatty acid metal salt and an inorganic lubricant in the ratio by mass of 8:2. The fatty acid metal salt was zinc stearate (GF-200, product of NOF CORPORATION), and the inorganic lubricant was boron nitride (NX5, product of Momentive Performance Materials Inc.). In this image bearing member-protecting agent, density A at the end portions thereof was 45% higher than density B at the central portion thereof.

Example 6

An image bearing member-protecting agent used was formed through compression molding of a mixture of a fatty acid metal salt and an inorganic lubricant in the ratio by mass of 8:2. The fatty acid metal salt was zinc stearate (GF-200, product of NOF CORPORATION), and the inorganic lubricant was boron nitride (NX5, product of Momentive Performance Materials Inc.). In this image bearing member-protecting agent, density A at the end portions thereof was 25% higher than density B at the central portion thereof.

Example 7

An image bearing member-protecting agent used was formed through compression molding of a mixture of a fatty acid metal salt and an inorganic lubricant in the ratio by mass of 8:2. The fatty acid metal salt was zinc stearate (GF-200, product of NOF CORPORATION), and the inorganic lubricant was boron nitride (NX5, product of Momentive Performance Materials Inc.). In this image bearing member-protecting agent, density A at the end portions thereof was 50% higher than density B at the central portion thereof.

Comparative Example 1

An image bearing member-protecting agent used was formed as follows. Specifically, a fatty acid metal salt was melted and charged into a mold, followed by cooling for molding. The fatty acid metal salt was zinc stearate (GF-200, product of NOF CORPORATION).

All protecting agents currently used in image forming apparatuses are produced in this manner. Also, in this image bearing member-protecting agent, density A at the end portions thereof was the same as density B at the central portion thereof.

Comparative Example 2

An image bearing member-protecting agent used was formed through compression molding of a fatty acid metal salt. The fatty acid metal salt was zinc stearate (GF-200, product of NOF CORPORATION). Also, in this image bearing member-protecting agent, density A at the end portions thereof was the same as density B at the central portion thereof.

Comparative Example 3

An image bearing member-protecting agent used was formed as follows. Specifically, a fatty acid metal salt and an inorganic lubricant were mixed in the ratio by mass of 8:2, and the resultant mixture was melted and charged into a mold, followed by cooling for molding. The fatty acid metal salt was zinc stearate (GF-200, product of NOF CORPORATION). The inorganic lubricant was boron nitride (NX5, product of Momentive Performance Materials Inc.). Also, in this image bearing member-protecting agent, density A at the end portions thereof was the same as density B at the central portion thereof.

Comparative Example 4

A image bearing member-protecting agent used was formed through compression molding of a mixture of a fatty acid metal salt and an inorganic lubricant in the ratio by mass of 8:2. The fatty acid metal salt was zinc stearate (GF-200, product of NOF CORPORATION), and the inorganic lubricant was boron nitride (NX5, product of Momentive Performance Materials Inc.). Also, in this image bearing member-protecting agent, density A at the end portions thereof was the same as density B at the central portion thereof.

Comparative Example 5

An image bearing member-protecting agent used was formed through compression molding of a mixture of a fatty acid metal salt and an inorganic lubricant in the ratio by mass of 8:2. The fatty acid metal salt was zinc stearate (GF-200, product of NOF CORPORATION), and the inorganic lubricant was boron nitride (NX5, product of Momentive Performance Materials Inc.). Also, in this image bearing member-protecting agent, density A at the end portions thereof was 2% lower than (−2% higher than) density B at the central portion thereof.

In each of Examples and Comparative Examples, the degree of staining of the charging member and the photoconductor, and the degree of ununiform consumption of the image bearing member-protecting agent were visually observed. The results are shown in Tables 1-1 and 1-2.

Notably, the evaluation criteria used are as follows.

Staining of Charging Member

A: Almost no stains of the charging member observed

B: Slight stains observed, but not adversely affect images at ambient temperature; allowable level C: Abnormal images formed at an early stage; unusable Staining of Photoconductor A: Almost no abrasion and filming of photoconductor observed B: Slight filming observed, but allowable level C: Abnormal images formed at an early stage; unusable Ununiform Scraping of Image Bearing Member-Protecting Agent A: Almost no ununiform scraping observed B: A low degree of ununiform scraping observed; allowable level C: A relatively high degree of ununiform scraping observed; not suitable for use so much D: Severe ununiform scraping observed; unusable

TABLE 1-1

| | Composition | Prodn. method | Density | Density A ($g/cm^3$) | Density B ($g/cm^3$) | X (g) | Y (g) | Results 1 | 2 | 3 |
|---|---|---|---|---|---|---|---|---|---|---|
| Ex. 1 | Zinc stearate + boron nitride | CM | A/B = 1.006 | 1.169 | 1.162 | 78.3 | 0.078 | A | A | A |
| Ex. 2 | Zinc stearate + | CM | A/B = 1.05 | 1.148 | 1.093 | 73.4 | 0.74 | A | A | A |

TABLE 1-1-continued

| | Composition | Prodn. method | Density | Density A ($g/cm^3$) | Density B ($g/cm^3$) | X (g) | Y (g) | Results 1 | 2 | 3 |
|---|---|---|---|---|---|---|---|---|---|---|
| | boron nitride | | | | | | | | | |
| Ex. 3 | Calcium stearate + boron nitride | CM | A/B = 1.006 | 1.169 | 1.162 | 78.3 | 0.078 | A | B | A |
| Ex. 4 | Zinc stearate + mica | CM | A/B = 1.004 | 1.175 | 1.17 | 78.5 | 0.078 | B | A | A |
| Ex. 5 | Zinc stearate + boron nitride | CM | A/B = 1.44 | 1.202 | 0.833 | 58.1 | 4.92 | A | A | A |
| Ex. 6 | Zinc stearate + boron nitride | CM | A/B = 1.25 | 1.192 | 0.952 | 64 | 3.21 | A | A | A |
| Ex. 7 | Zinc stearate + boron nitride | CM | A/B = 1.48 | 1.203 | 0.811 | 58.1 | 5.23 | A | A | A |

*CM denotes compression molding

*X (g) and Y (g) denote respectively "Amount of raw materials uniformly charged" and "Total amount of raw materials additionally charged in both ends"

*Results 1, 2 and 3 correspond respectively to "Staining of charging member," "Staining of photoconductor" and "Ununiform scraping of image bearing member-protecting agent"

TABLE 1-2

| | Composition | Prodn. method | Density | Density A ($g/cm^3$) | Density B ($g/cm^3$) | X (g) | Y (g) | Results 1 | 2 | 3 |
|---|---|---|---|---|---|---|---|---|---|---|
| Comp. Ex. 1 | Zinc stearate | MM | A/B = 1.0 | — | — | — | — | C | B | B |
| Comp. Ex. 2 | Zinc stearate | CM | A/B = 1.0 | 1.15 | 1.15 | 76.2 | 0 | C | B | C |
| Comp. Ex. 3 | Zinc stearate + boron nitride | MM | A/B = 1.0 | — | — | — | — | B | C | B |
| Comp. Ex. 4 | Zinc stearate + boron nitride | CM | A/B = 1.0 | 1.055 | 1.055 | 70.8 | 0 | A | A | C |
| Comp. Ex. 5 | Zinc stearate + boron nitride | CM | A/B = 0.98 | 1.155 | 1.179 | 77.6 | −0.036 | A | A | D |

*MM and CM denote respectively melt molding and compression molding

*X (g) and Y (g) denote respectively "Amount of raw materials uniformly charged" and "Total amount of raw materials additionally charged in both ends"

*Results 1, 2 and 3 correspond respectively to "Staining of charging member," "Staining of photoconductor" and "Ununiform scraping of image bearing member-protecting agent"

From comparison of Examples with Comparative Examples in Tables 1-1 and 1-2, when the image bearing member-protecting agent was formed through compression molding of a mixture containing the fatty acid metal salt and the inorganic lubricant, and satisfies the relation $1.0<A/B$, especially $1.0<A/B\leqq 1.5$, where A denotes a density at the end portions of the protecting agent and B denotes a density at the central portion thereof, it was found that ununiform scraping of the protecting agent could be effectively suppressed, and that staining of the charging member and staining of the photoconductor (image bearing member) could also be effectively suppressed.

Specifically, from comparison of Examples 1 to 7 with Comparative Examples 1 to 5, it was found that densities A and B must satisfy the relation $1.0<A/B$.

Also, it was found that zinc stearate is preferably used as the fatty acid metal salt from comparison of Example 1 with Example 3, and that boron nitride is preferably used as the inorganic lubricant from comparison of Example 1 with Example 4.

Although preferred embodiments of the present invention are described above, the present invention is not limited to these specific embodiments. Unless specifically specified in the above description, the present invention can be variously altered or modified without departing from the scope defined by the appended claims.

In one modification embodiment, the image bearing member may be an intermediate transfer member like the transfer belt 11 in the above embodiment, although the image bearing member is a photoconductor in the embodiment described in Examples. In this case, the image bearing member-protecting agent of the present invention is applied to the intermediate transfer member by the protecting agent-supplying device of the present invention, and this transfer member corresponds to the recording paper in the above embodiment. The process cartridge of the present invention contains the intermediate transfer member. A cleaning device for the intermediate transfer member may be, for example, the cleaning device 13 described in the above embodiment. A charging unit for the intermediate transfer member may be, for example, the primary transfer rollers 12Y, 12M, 12C and 12BK or the secondary transfer roller 5.

The process cartridge of the present invention contains at least the image bearing member and the protecting agent-supplying device in the form of a single member, and may be detachably mounted on the main body of the image forming apparatus. Other constituent parts of the process cartridge are appropriately selected in consideration of service life, cost and mountability onto the process cartridge of the image bearing member and the other constituent parts.

The present invention can be applied to not only a so-called tandem image forming apparatus but also a so-called 1 drum-image forming apparatus in which toner images of colors are sequentially formed on one photoconductor drum and superposed sequentially on top of the other to obtain a full color image. In addition, the present invention can be applied to not only color image forming apparatuses but also monochromatic image forming apparatuses. In either image forming apparatus, the toner images of colors may be directly transferred onto, for example, a recording paper sheet with no use of the intermediate transfer member. In this configuration, the transfer belt 11 illustrated in, for example, FIG. 2 corresponds to the recording paper sheet.

The effects obtained by the above-described embodiments of the present invention are merely most preferable effects obtained in the present invention. The effects of the present invention should not be construed as being limited to those described in the embodiments of the present invention.

What is claimed is:

1. An image bearing member-protecting agent which is supplied to an image bearing member for protecting the image bearing member, the image bearing member-protecting agent comprising:

a fatty acid metal salt, and an inorganic lubricant, wherein the image bearing member-protecting agent is formed by compression molding of powder containing at least the fatty acid metal salt and the inorganic lubricant, and wherein the image bearing member-protecting agent satisfies the relation $1.0<A/B$, where A denotes a density at end portions in the longitudinal direction of the image bearing member-protecting agent and B denotes a density at a central portion in the longitudinal direction of the image bearing member-protecting agent.

2. The image bearing member-protecting agent according to claim 1, wherein the image bearing member-protecting agent satisfies the relation $1.0<A/B\leqq 1.45$.

3. The image bearing member-protecting agent according to claim 1, wherein the fatty acid metal salt is zinc stearate.

4. The image bearing member-protecting agent according to claim 1, wherein the inorganic lubricant is boron nitride.

5. A protecting agent-supplying device comprising:

an image bearing member-protecting agent which is supplied to an image bearing member for protecting the image bearing member, wherein the image bearing member-protecting agent comprises a fatty acid metal salt and an inorganic lubricant, wherein the image bearing member-protecting agent is formed by compression molding of powder containing at least the fatty acid metal salt and the inorganic lubricant, and wherein the image bearing member-protecting agent satisfies the relation $1.0<A/B$, where A denotes a density at end portions in the longitudinal direction of the image bearing member-protecting agent and B denotes a density at a central portion in the longitudinal direction of the image bearing member-protecting agent.

6. The protecting agent-supplying device according to claim 5, further comprising a supplying member which scrapes off the image bearing member-protecting agent and supplies the image bearing member-protecting agent to an image bearing member.

7. The protecting agent-supplying device according to claim 5, further comprising a layer-forming member which forms a layer, on the image bearing member, of the image bearing member-protecting agent supplied on the image bearing member.

8. An image forming apparatus comprising:

a protecting agent-supplying device, and an image bearing member, wherein the protecting agent-supplying device comprises an image bearing member-protecting agent which is supplied to the image bearing member for protecting the image bearing member, wherein the image bearing member-protecting agent comprises a fatty acid metal salt and an inorganic lubricant, wherein the image bearing member-protecting agent is formed by compression molding of powder containing at least the fatty acid metal salt and the inorganic lubricant, and wherein the image bearing member-protecting agent satisfies the relation $1.0<A/B$, where A denotes a density at end portions in the longitudinal direction of the image bearing member-protecting agent and B denotes a density at a central portion in the longitudinal direction of the image bearing member-protecting agent.

9. The image forming apparatus according to claim 8, further comprising a cleaning device for removing from the image bearing member toner particles remaining on the image bearing member, wherein the cleaning device is provided so as to be in contact with the image bearing member, and wherein the cleaning device is located, in a direction in which the image bearing member is moved, downstream of a position where a toner image on the image bearing member is transferred onto a recording medium but upstream of a position where an image-bearing member protecting agent is supplied by the protecting agent-supplying device.

10. The image forming apparatus according to claim 8, wherein the image bearing member has a layer containing a thermosetting resin at least the uppermost surface thereof.

11. The image forming apparatus according to claim 8, further comprising a charging unit which is provided so as to face the image bearing member and configured to charge the image bearing member.

12. The image forming apparatus according to claim 11, wherein the charging unit comprises a voltage-applying unit configured to apply a voltage containing an alternating-current component.

* * * * *